US011037501B2

(12) United States Patent
Li

(10) Patent No.: US 11,037,501 B2
(45) Date of Patent: Jun. 15, 2021

(54) DISPLAY PANEL, METHOD FOR DRIVING THE SAME, AND DISPLAY DEVICE

(71) Applicant: Shanghai Tianma AM-OLED Co., Ltd., Shanghai (CN)

(72) Inventor: Yue Li, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/587,047

(22) Filed: Sep. 30, 2019

(65) Prior Publication Data

US 2020/0027404 A1 Jan. 23, 2020

(30) Foreign Application Priority Data

Apr. 22, 2019 (CN) ..... 201910324138.X

(51) Int. Cl.
*G09G 3/36* (2006.01)
*G09G 3/3266* (2016.01)

(52) U.S. Cl.
CPC ... *G09G 3/3266* (2013.01); *G09G 2310/0286* (2013.01)

(58) Field of Classification Search
CPC . G09G 3/36; G09G 5/00; G11C 19/00; G02F 1/1345; G06F 3/038
See application file for complete search history.

(56) References Cited

U.S. PATENT DOCUMENTS

2005/0264496 A1* 12/2005 Shin ..... G09G 3/3233 345/76
2009/0262058 A1* 10/2009 Pak ..... G09G 3/3648 345/92
2010/0328281 A1 12/2010 Okada et al.
2018/0059497 A1* 3/2018 Lee ..... G09G 3/3266
2019/0088181 A1* 3/2019 Ma ..... G09G 3/20

FOREIGN PATENT DOCUMENTS

| | | | |
|---|---|---|---|
| CN | 1674074 | A | 9/2005 |
| CN | 101105918 | A | 1/2008 |
| CN | 101350179 | A | 1/2009 |
| CN | 104050909 | A | 9/2014 |
| CN | 104077995 | A | 10/2014 |
| CN | 106782386 | A | 5/2017 |
| CN | 108364611 | A | 8/2018 |
| KR | 20140092574 | A | 7/2014 |

* cited by examiner

*Primary Examiner* — Pegeman Karimi
(74) *Attorney, Agent, or Firm* — Kilpatrick Townsend & Stockton, LLP

(57) ABSTRACT

The disclosure relates to the field of display technologies, and discloses a display panel, a method for driving the same, and a display device. In embodiments of the disclosure, a switch circuit is between a group of shift registers and respective gate lines to transmit a scan signal output by the corresponding shift register group to the respective gate lines, wherein the shift register group performs forward or backward scanning on the respective gate lines, that is, the display device can perform both forward scanning and backward scanning so that an application field of the display device can be greatly extended.

16 Claims, 10 Drawing Sheets

DISPLAY PANEL, METHOD FOR DRIVING THE SAME, AND DISPLAY DEVICE

CROSS-REFERENCE TO RELATED APPLICATION

This application claims the benefit of Chinese Patent Application No. 201910324138.X, filed with the Chinese Patent Office on Apr. 22, 2019, the content of which is hereby incorporated by reference in its entirety.

FIELD

The present disclosure relates to the field of display technologies, and particularly to a display panel, a method for driving the same, and a display device.

BACKGROUND

An electroluminescent display, e.g., an Organic Light-Emitting Diode (OLED) display, is a self-emitting display in which a display function can be enabled without arranging a backlight module as in a liquid crystal display, so that the electroluminescent display can be made thinner and more lightweight.

The electroluminescent display can be a display screen of a watch, for example, and although the electroluminescent display can provide the watch with a variety of display functions, if the watch is not provided with an ear, then it may tend to be worn improperly in a black screen state, and at this time, if backward scanning cannot be performed in the watch, then a user will pull off and wear the watch again, so that it will take a long period of time for the user to wear the watch, thus degrading an experience of the user.

Accordingly, performing both forward scanning and backward scanning in the electroluminescent display is advantageous.

SUMMARY

Embodiments of the disclosure provide a display panel, a method for driving the same, and a display device so as to perform both forward scanning and backward scanning in an electroluminescent display.

One embodiment of the disclosure provides a display panel including gate lines, a shift register group including cascaded shift registers, and the shift registers are electrically connected with their corresponding gate lines, and the shift register group is configured to output scan signals for forward or backward scanning; and a switch circuit, located between the shift register group and the respective gate lines, and configured to transmit the scan signals for forward or backward scanning output by the corresponding shift register group to the respective gate lines, wherein the shift register group performs forward or backward scanning on the respective gate lines.

Another embodiment of the disclosure provides a display device including the display panel above according to the embodiment of the disclosure.

Another embodiment of the disclosure provides a method for driving the display panel above according to the embodiment of the disclosure, the method including in the condition that forward scanning on the respective gate lines, transmitting the scan signals for forward scanning output by the corresponding shift register group to the respective gate lines through the switch circuit connected with the shift register group for performing forward scanning on the respective gate lines; and for backward scanning on the respective gate lines, transmitting the scan signals for backward scanning output by the corresponding shift register group to the respective gate lines through the switch circuit connected with the shift register group for performing backward scanning on the respective gate lines.

DETAILED DESCRIPTION OF THE EMBODIMENTS

Particular implementations of a display panel, a method for driving the same, and a display device according to the embodiments of the disclosure will be described below in details with reference to the drawings. It shall be noted that the embodiments to be described are only a part but not all of the embodiments of the disclosure.

Figure 1:
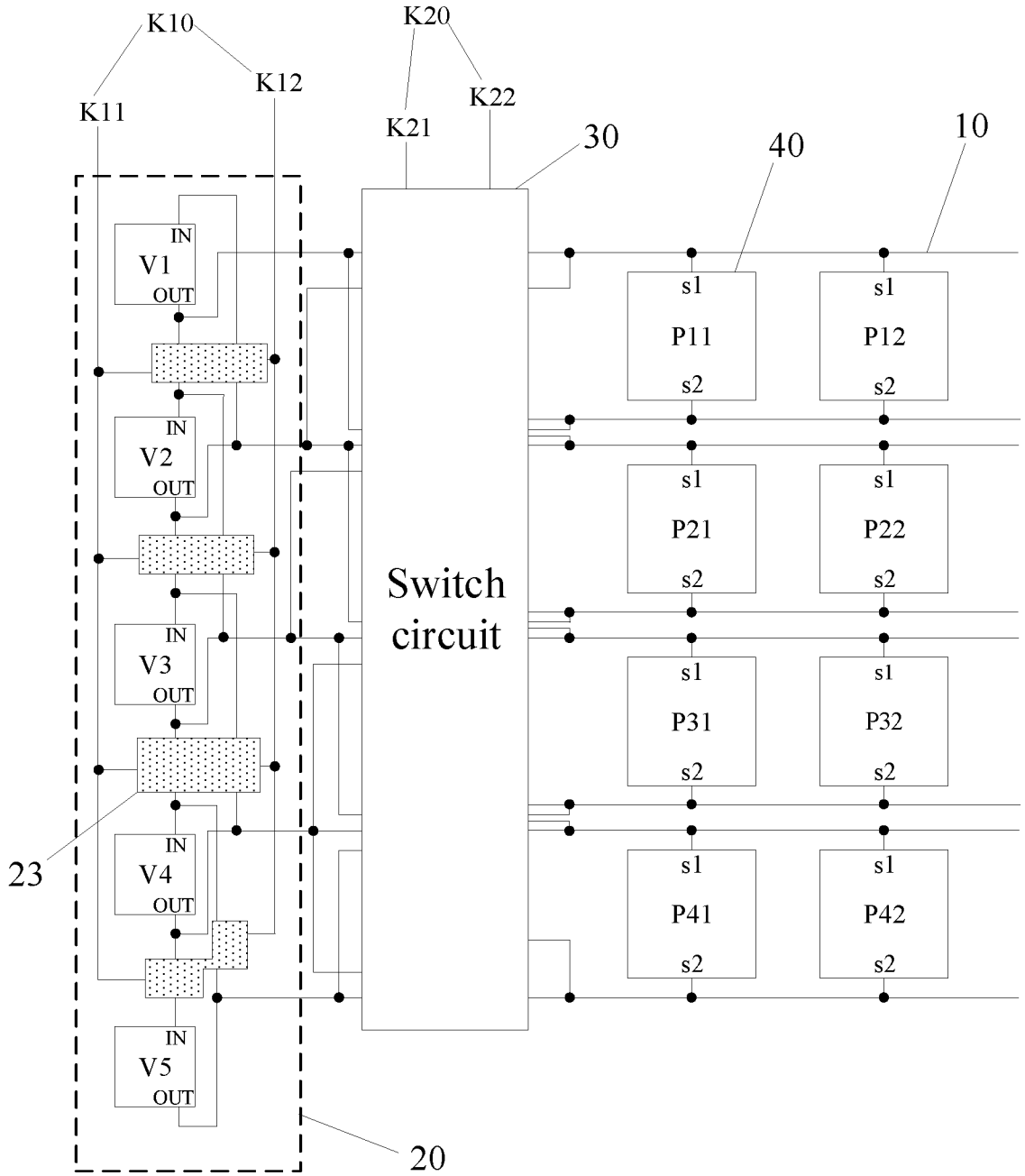
FIG. 1 is a schematic structural diagram of a display panel including one shift register group according to embodiments of the disclosure.
Figure 2:
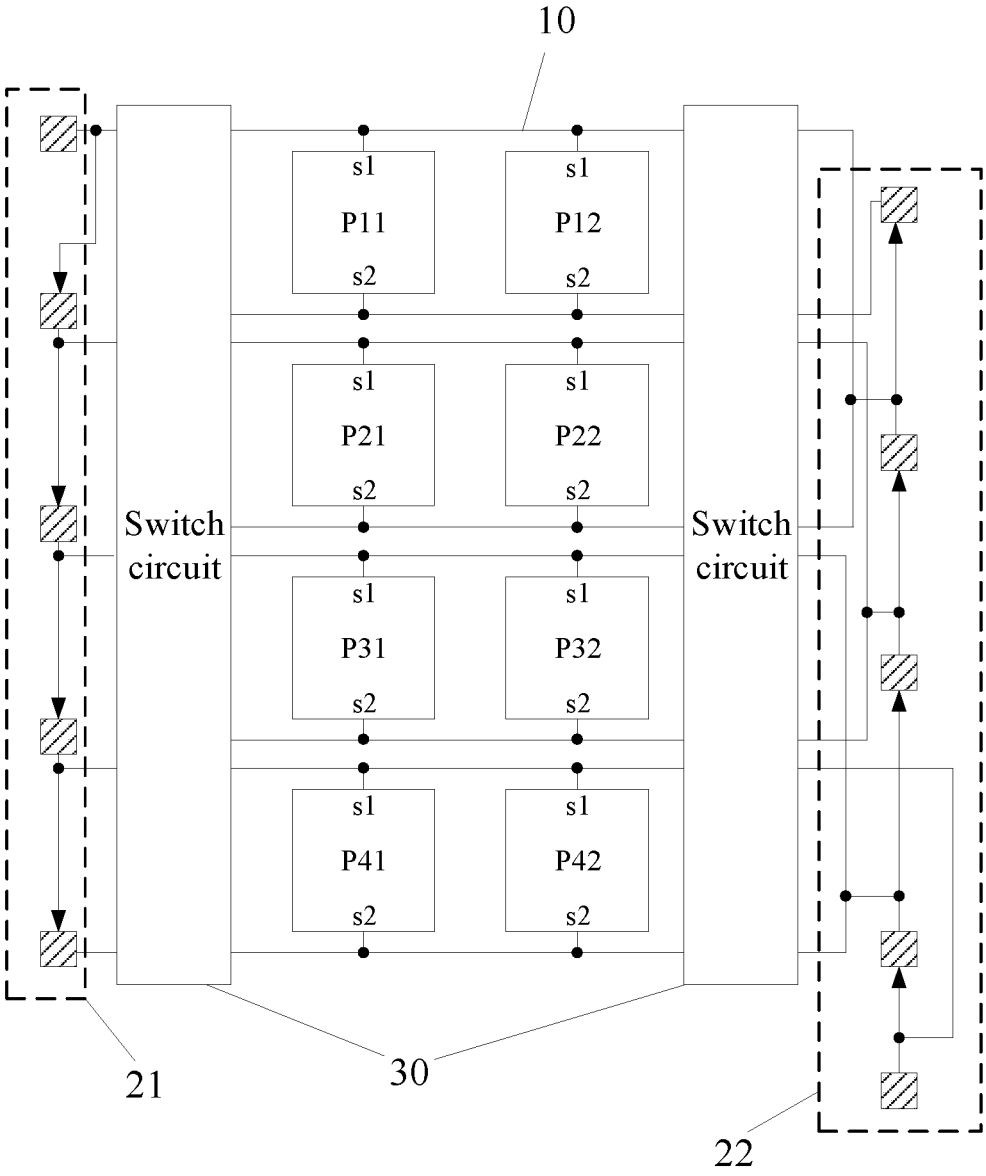
FIG. 2 is a schematic structural diagram of a display panel including two groups of shift registers according to the embodiments of the disclosure.

FIG. 1 and FIG. 2 illustrate a display panel according to embodiments of the disclosure, where FIG. 1 is a schematic structural diagram of a display panel including one shift register group according to embodiments of the disclosure, and FIG. 2 is a schematic structural diagram of a display panel including two groups of shift registers according to the embodiments of the disclosure. The display panel can include:

gate lines 10;

at least one group (20 as illustrated in FIGS. 1, and 21 and 22 as illustrated in FIG. 2) of shift registers each including cascaded shift registers, where the shift registers are electrically connected with their corresponding gate lines 10, and the shift register group is configured to output a scan signal for forward scanning, or to output a scan signal for backward scanning; and a switch circuit 30, located between the shift register group and the respective gate lines 10, and configured to transmit the scan signals for forward or backward scanning output by the corresponding shift register group to the respective gate lines 10, wherein the corresponding shift register group performs forward or backward scanning on the respective gate lines 10.

In the display panel, the method for driving the same, and the display device according to the embodiments of the disclosure, the switch circuit is arranged between the shift register group and the respective gate lines to transmit the scan signal output by the corresponding shift register group to the respective gate lines, wherein the shift register group performs forward or backward scanning on the respective gate lines, that is, a display device can perform both forward scanning and backward scanning so that an application field of the display device can be greatly extended.

In the embodiments of the disclosure, the switch circuit 30 is between the shift register group and the respective gate lines 10 to transmit the scan signals for forward or backward scanning output by the corresponding shift register group to the respective gate lines 10, wherein the corresponding shift register group performs forward or backward scanning on the respective gate lines 10, that is, a display device can perform both forward scanning and backward scanning so that an application field of the display device can be greatly extended.

In some embodiments, the shift register group can be arranged in the following several schemes.

In a first scheme, the display panel includes only one shift register group 20 arranged at one end of the gate lines 10, and for example, the shift register group 20 can be on the left end of the gate lines 10 as illustrated in FIG. 1. Of course, the shift register group 20 can alternatively be on the right end of the gate lines 10 (not illustrated), although the embodiments of the disclosure will not be limited thereto.

At this time, the shift register group 20 can perform both forward scanning on the respective gate lines (e.g., scan the respective gate lines 10 sequentially from the top down), and backward scanning on the respective gate lines (e.g., scan the respective gate lines 10 sequentially from the bottom up), so one shift register group 20 can perform both forward scanning and backward scanning to thereby greatly reduce number of shift registers to be arranged, and since the shift registers are generally arranged in a bezel area of the display panel, an area occupied by the bezel area can be greatly reduced to thereby provide the display panel with a narrow bezel.

In some embodiments, if both forward scanning and backward scanning is to be performed by one shift register group 20, then in the embodiments of the disclosure, the display panel may further include a gate circuit control signal line K10 including a third sub-signal line K11 and a fourth sub-signal line K12 as illustrated in FIG. 1.

Furthermore as illustrated in FIG. 1, the shift register group 20 includes switching elements 23 between any two adjacent levels of shift registers, where each switching element 23 is electrically connected respectively with the third sub-signal line K11 and the fourth sub-signal line K12, and is configured to transmit a scan signal output at an output terminal of a first shift register to an input terminal of a second shift register under the control of a first control signal provided by the third sub-signal line K11, and to output a scan signal output at an output terminal of the second shift register to an input terminal of the first shift register under the control of a second control signal provided by the fourth sub-signal line K12, where the first shift register and the second shift register are two adjacent levels of shift registers.

As illustrated in FIG. 1, for example, there are only five shift registers, but this will not suggest that the real shift register group 20 may include only five shift registers, and the shift register group 20 including five shift registers is illustrated here only by way of an example so as to illustrate the structure of the shift register group 20 clearly.

Here a shift register denoted as V3 is a first shift register, a shift register denoted as V4 is a second shift register, and each switching element 23 can provide a scan signal output at an output terminal OUT of the shift register V3 to an input terminal IN of the shift register V4 under the control of the first control signal provided by the third sub-signal line K11, and provide a scan signal output at an output terminal of the shift register V4 to an input terminal IN of the shift register V3 under the control of the second control signal provided by the fourth sub-signal line K12.

In this way, the switching elements 23 are arranged so that for forward scanning, a scan signal output at an output terminal of a preceding shift register (which refers to a shift register with a lower number, where the numbers of the five shift registers are sorted in an ascending order as V1<V2<V3<V4<V5) is transmitted to an input terminal of a succeeding shift register (which refers to a shift register with a higher number) as a start signal of the succeeding shift register, and for backward scanning, a scan signal output at an output terminal of the shift register shift is transmitted to an input terminal of the preceding shift register as a start signal of the preceding shift register, so that both forward scanning and backward scanning can be performed normally.

Figure 3:
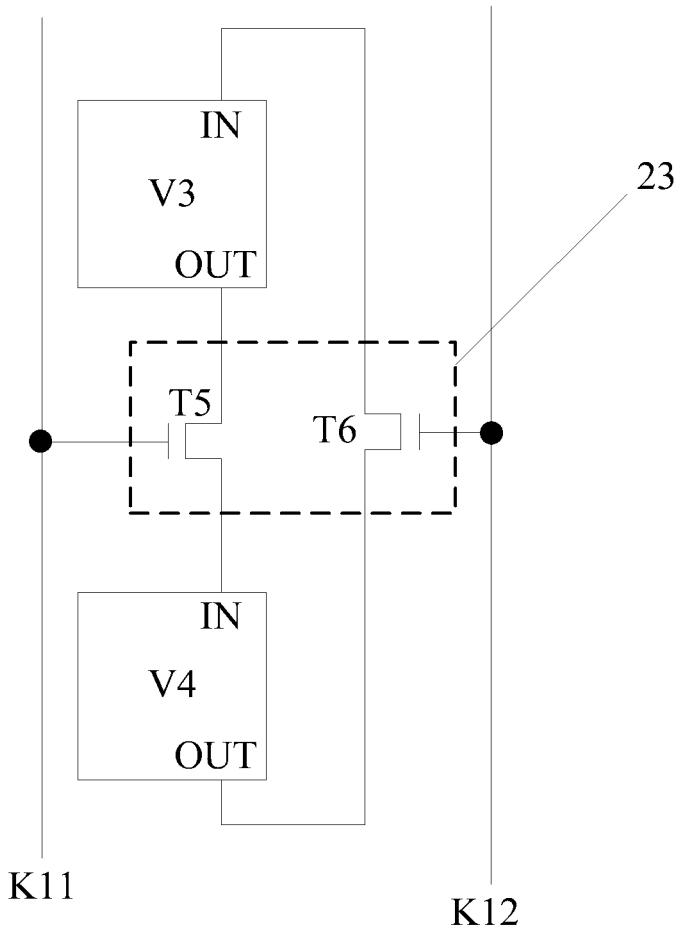
FIG. 3 is a schematic structural diagram in details of a switching element according to the embodiments of the disclosure.

In some embodiments, in order to perform the function of each switching element 23, in the embodiments of the disclosure, as illustrated in FIG. 3 which is a schematic structural diagram in details of the switching element 23, the switching element 23 includes a fifth switch transistor T5 and a sixth switch transistor T6, where a gate of the fifth switch transistor T5 is electrically connected with the third sub-signal line K11, a source of the fifth switch transistor T5 is electrically connected with the output terminal of the first shift register, and a drain of the fifth switch transistor T5 is electrically connected with the input terminal of the second shift register, and a gate of the sixth switch transistor T6 is electrically connected with the fourth sub-signal line K12, a source of the sixth switch transistor T6 is electrically connected with the output terminal of the second shift register, and a drain of the sixth switch transistor T6 is electrically connected with the input terminal of the first shift register.

In some embodiments, both the fifth switch transistor T5 and the sixth switch transistor T6 can be P-type transistors or N-type transistors. It shall be noted that in order to enable the shift registers to operate normally, when the fifth switch transistor T5 and the sixth switch transistor T6 are of the same type, one of the fifth switch transistor T5 and the sixth switch transistor T6 is turned on, and the other switch transistor is turned off, that is, the control signal input on the third sub-signal line K11 is different with the control signal input on the fourth sub-signal line K12, that is, the first control signal provided by the third sub-signal line K11, and the second control signal provided by the fourth sub-signal line K12 are different signals.

As illustrated in FIG. 3, for example, both the fifth switch transistor T5 and the sixth switch transistor T6 are P-type transistors, and at this time, when a low-level signal is output on the third sub-signal line K11, the fifth switch transistor T5 is turned on, and transmits the scan signal output at the output terminal OUT of the shift register V3 to the input terminal IN of the shift register V4; and a high-level signal is output on the fourth sub-signal line K12 so that the sixth switch transistor T6 is turned off, and stops the scan signal output at the output terminal OUT of the shift register V4 from being transmitted to the input terminal IN of the shift register V3.

Of course, the fifth switch transistor T5 and the sixth switch transistor T6 can alternatively be of different types. For example, when the fifth switch transistor T5 is a P-type transistor, the sixth switch transistor T6 is an N-type transistor, or when the fifth switch transistor T5 is an N-type transistor, the sixth switch transistor T6 is a P-type transistor.

It shall be noted that in order to enable the shift registers to operate normally, and in order to one of the fifth switch transistor T5 and the sixth switch transistor T6 to be turned on, and the other switch transistor to be turned off, when the fifth switch transistor T5 and the sixth switch transistor T6 are of different types, the control signal input on the third sub-signal line K11 is same as the control signal input on the fourth sub-signal line K13, that is, the first control signal provided by the third sub-signal line K11, and the second control signal provided by the fourth sub-signal line K12 are the same signal.

As illustrated in FIG. 3, for example, if the fifth switch transistor T5 is a P-type transistor, the sixth switch transistor T6 is an N-type transistor, and both of the control signals input on the third sub-signal line K11 and the fourth sub-signal line K12 are low-level signals, only the fifth switch transistor T5 is turned on, and the sixth switch transistor T6 are turned off. At this time, the scan signal output at the output terminal OUT of the shift register V3 can be transmitted to the input terminal IN of the shift register V4, and the scan signal output at the output terminal OUT of the shift register V4 will not be transmitted to the input terminal IN of the shift register V3, so that the respective shift registers can operate normally, thus avoiding interference.

In some embodiments, the particular structure of the switching element 23 will not be limited to the structure as illustrated in FIG. 3, but can alternatively be any structure for performing the switching function of the switching element 23, although the embodiments of the disclosure will not be limited thereto.

In some embodiments, the display panel can further include a start signal line STV for providing a start signal, where a start signal is provided on the start signal line STV to an input terminal of the first level of shift register so that the shift registers operate normally.

Figure 4A:
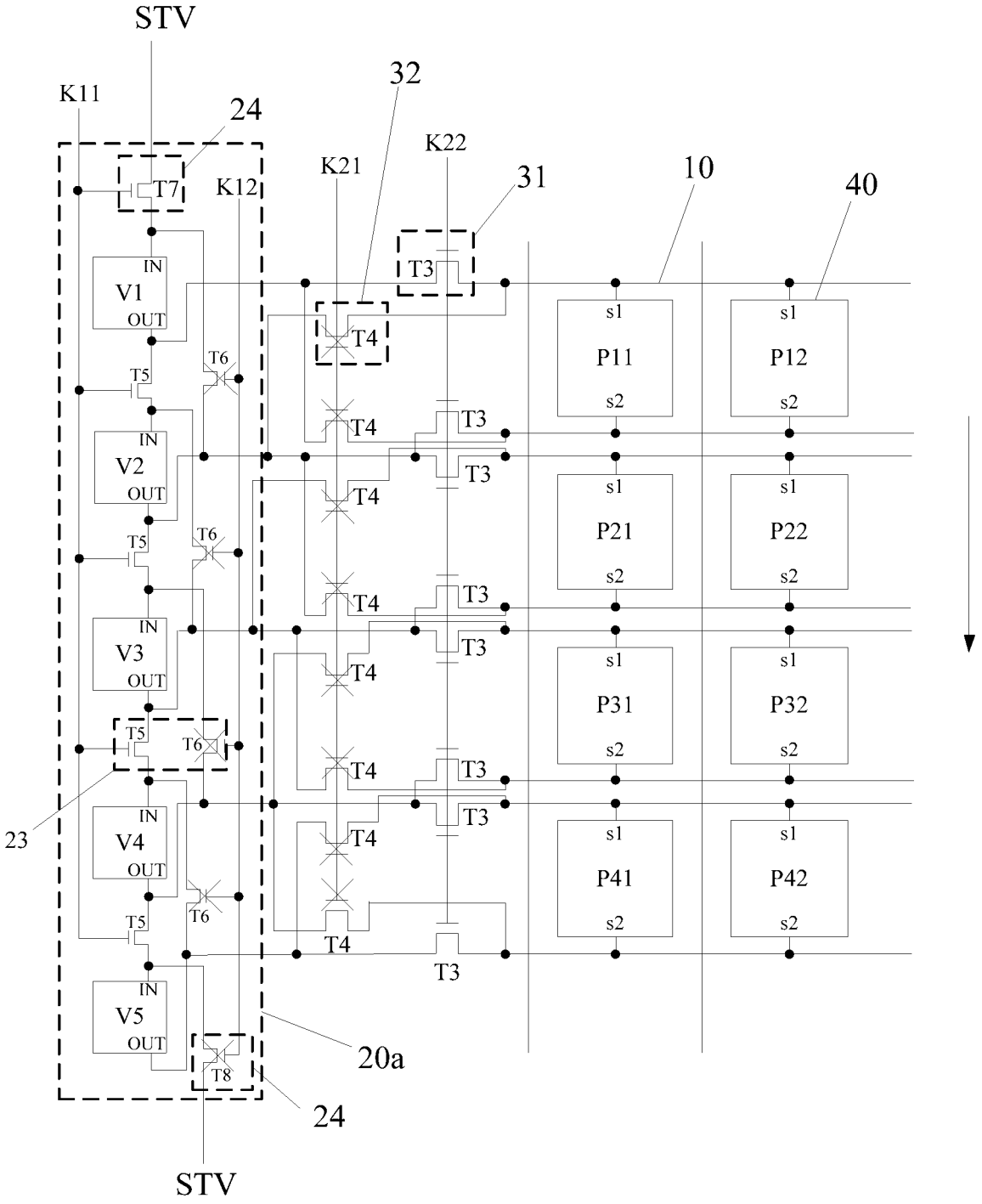
FIG. 4A is a schematic diagram the display panel including one shift register group according to the embodiments of the disclosure in which forward scanning is performed.
Figure 4B:
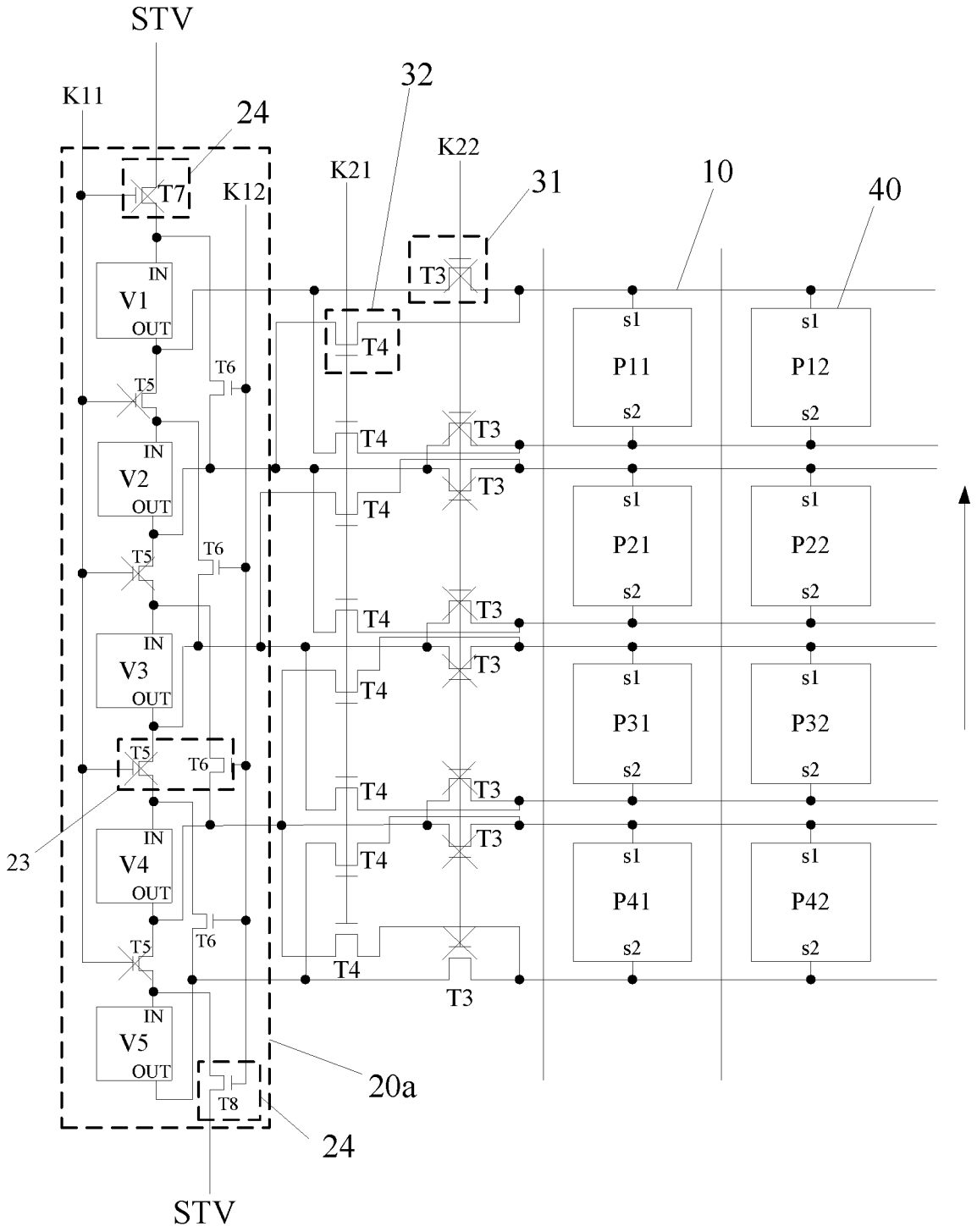
FIG. 4B is a schematic diagram the display panel including one shift register group according to the embodiments of the disclosure in which backward scanning is performed.

As illustrated in FIG. 4A and FIG. 4B, for example, which are schematic structural diagrams of respective components in the shift register group 20 in the display panel including one shift register group 20, for forward scanning, as illustrated in FIG. 4A, the shift register denoted as V1 is the first level of shift register, and the input terminal IN of the shift register V1 shall be electrically connected with the start signal STV; and for backward scanning, as illustrated in FIG. 4B, the shift register denoted as V5 is the first level of shift register, and the input terminal IN of the shift register V5 shall be electrically connected with the start signal line STV.

It shall be noted that a switch transistor with "×" in FIG. 4A and FIG. 4B represents a switch transistor which remains turned off instead of being turned on during scanning. In FIG. 4A, when a switch transistor with "×" represents a switch transistor which is turned off, the shift register group 20 can perform forward scanning on the respective gate lines; and in FIG. 4B, when a switch transistor with "×" represents a switch transistor which is turned off, the shift register group can perform backward scanning on the respective gate lines.

Furthermore the display panel further includes a driving integrated circuit electrically connected with the start signal line STV (not illustrated in FIG. 4A or FIG. 4B), where the driving integrated circuit outputs a start signal to the start signal line STV, and then the start signal is transmitted on the start signal line STV to a component for which the start signal is required.

It shall be noted that there may be two start signal lines STV (not illustrated), where one of the start signal lines (represented as a) is electrically connected with the input terminal IN of the shift register V1, and the other start signal line (represented as b) is electrically connected with the input terminal IN of the shift register V5. Since there are two start signal lines STV (e.g., a and b), for forward scanning, for example, a start signal can be input on the start signal line a to the input terminal IN of the shift register V1, and a start signal can be stopped from being input on the start signal line b to the input terminal IN of the shift register V5, so that scanning can be performed normally while the respective shift registers are operating normally.

In this way, two start signal lines STV are arranged so that a start signal can be input to the corresponding shift registers on different occasions to thereby perform scanning normally while the respective shift registers are operating normally.

Of course, alternatively there may be one start signal line STV, and at this time, the start signal line STV is electrically connected with both the input terminal IN of the shift register V1, and the input terminal IN of the shift register V5 as illustrated in FIG. 4A and FIG. 4B.

Since the input terminal In of the shift register V1 is also electrically connected with the output terminal OUT of the shift register denoted as V2 through the switching element 23, for backward scanning, in order to avoid both the scan signal output at the output terminal OUT of the shift register V2, and the start signal provided by the start signal line STV to be input to the input terminal IN of the shift register V1, and for forward scanning, in order to avoid both the scan signal output at the output terminal OUT of the shift register V4, and the start signal provided by the start signal line STV to be input to the input terminal IN of the shift register V5, the shift register group 20 can be arranged as follows in the embodiments of the disclosure.

As illustrated in FIG. 4A and FIG. 4B, the shift register group 20 includes a gate circuit control unit 24 electrically connected respectively with the first shift register, the last shift register, the start signal line STV, the third sub-signal line K11, and the fourth sub-signal line K12, where the gate circuit control unit 24 is configured to control the start signal provided by the start signal line STV to be transmitted to the input terminal of the first shift register, under the control of the first control signal provided by the third sub-signal line K11, and control the start signal provided by the start signal line STV to be transmitted to the input terminal of the last shift register, under the control of the second control signal provided by the fourth sub-signal line K12.

As illustrated in FIG. 4A and FIG. 4B, for example, the gate circuit control unit 24 can transmit the start signal provided by the start signal line STV to the input terminal IN of the shift register V1 under the control of the first control signal provided by the third sub-signal line K11, and transmit the start signal provided by the start signal line STV to the input terminal IN of the shift register V5, under the control of the second control signal provided by the fourth sub-signal line K12.

In this way, two different signals can be avoided from being input to the input terminals of the shift registers, which would otherwise have operated out of order, so that the shift registers can operate normally to thereby perform scanning normally.

In some embodiments of the disclosure, as illustrated in FIG. 4A and FIG. 4B, the gate circuit control unit 24 can include a seventh switch transistor T7 and an eighth switch transistor T8, where a gate of the switch transistor T7 is electrically connected with the third sub-signal line K11, a source of the switch transistor T7 is electrically connected with the start signal line STV, and a drain of the switch transistor T7 is electrically connected with the input terminal of the first shift register, and a gate of the eighth switch transistor T8 is electrically connected with the fourth sub-signal line K12, a source of the eighth switch transistor T8 is electrically connected with the start signal line STV, and a drain of the eighth switch transistor T8 is electrically connected with the input terminal of the last shift register.

It shall be noted that for the types of the seventh switch transistor T7 and the eighth switch transistor T8, and relationships between these two switch transistors, and the control signals input on the third sub-signal line K11 and the fourth sub-signal line K12, reference can be made to the description above of the fifth switch transistor T5 and the sixth switch transistor T6, so a repeated description thereof will be omitted here.

Of course, the structure of the gate circuit control unit 24 will not be limited to the structures as illustrated in FIG. 4A and FIG. 4B, but can alternatively be another structure for performing the function of the gate circuit control unit 24, although the embodiments of the disclosure will not be limited thereto.

In a real implementation, the display panel can include pixel driving circuits 40 arranged in an array as illustrated in FIG. 1, FIG. 4A, and FIG. 4B, where each pixel driving circuit 40 can include a first input terminal (e.g., s1) and a second input terminal (e.g., s2).

It shall be noted that, for forward scanning, for example, as illustrated in FIG. 4A, an arrow represents a scanning order, and for two adjacent pixel driving circuits in the column direction, e.g., a pixel driving circuit P21 and a pixel driving circuit P31, firstly the pixel driving circuit P21 starts operating, and then the pixel driving circuit P31 starts operating, as denoted by the arrow; and both the second input terminal s2 of the pixel driving circuit P21, and the first input terminal s1 of the pixel driving circuit P31 are electrically connected with the output terminal OUT of the shift register V3, that is, the scan signal input to the second input terminal s2 of the pixel driving circuit P21 is same as the scan signal input to the first input terminal s1 of the pixel driving circuit P31.

For backward scanning, for example, as illustrated in FIG. 4B, an arrow represents a scanning order, and for two adjacent pixel driving circuits in the column direction, e.g., a pixel driving circuit P21 and a pixel driving circuit P11, firstly the pixel driving circuit P21 starts operating, and then the pixel driving circuit P11 starts operating, as denoted by the arrow; and both the second input terminal s2 of the pixel driving circuit P21, and the first input terminal s1 of the pixel driving circuit P11 are electrically connected with the output terminal OUT of the shift register V2, that is, the scan signal input to the second input terminal s2 of the pixel driving circuit P21 is same as the scan signal input to the first input terminal s1 of the pixel driving circuit P11.

Stated otherwise, no matter whether for forward scanning or for backward scanning, for two adjacent pixel driving circuits in the column direction, the scan signal input to the second input terminal of the pixel driving circuit firstly starting operating is same as the scan signal input to the first input terminal of the pixel driving circuit then starting operating; and for the same pixel driving circuit, the scan signal is input to firstly the first input terminal and then the second input terminal, that is, the scan signal input to the first input terminal and the scan signal input to the second input terminal are at specific timing.

Accordingly further to the pixel driving circuits designed as described above, if one shift register group 20 performs forward scanning and backward scanning on the respective gate lines 10, the respective shift registers in the shift register group 20, the respective gate lines 10, and the pixel driving circuits 40 are connected as follows. For the M number of shift register in the shift register group 20, the output terminal of the i-th shift register other than the first and M-th shift registers is electrically connected respectively with the first input terminals and the second input terminals of the (i−1)-th row of pixel driving circuits, and the first input terminals and the second input terminals of the i-th row of pixel driving circuits through four number of gate lines 10, the output terminal of the first shift register is electrically connected respectively with the first input terminals and the second input terminals of the first row of pixel driving circuits through two number of gate lines 10, and the M-th shift register is electrically connected respectively with the first input terminals and the second input terminals of the (M−1)-th row of pixel driving circuits through two number of gate lines 10, where i is an integer greater than 1 and less than M, and there are (M−1) rows of pixel driving circuits 40.

As illustrated in FIG. 4A and FIG. 4B, for example, there are only four rows of pixel driving circuits denoted respectively as P11, P12, P21, P22, P31, P32, P41, and P42, and the shift register group 20 includes five shift registers denoted respectively as V1, V2, V3, V4, and V5; and other than the shift register V1 and the shift register V5, the output terminal OUT of the shift register V2 is electrically connected respectively with the first input terminals (e.g., s1 of P11) and the second input terminals (e.g., s2 of P11) of the first row of pixel driving circuits, and the first input terminals (e.g., s1 of P21) and the second input terminals (e.g., s2 of P21) of the second row of pixel driving circuits through four number of gate lines 10, and the shift register V3 and the shift register V4 can be connected with the pixel driving circuits 40 like the shift register V2. The output terminal OUT of the shift register V1 are electrically connected respectively with the first input terminals (e.g., s1 of P11) and the second input terminals (e.g., s2 of P11) of the first row of pixel driving circuits on two number of gate lines 10. The output terminal OUT of the shift register V5 are electrically connected respectively with the first input terminals (e.g., s1 of P41) and the second input terminals (e.g., s2 of P41) of the fourth row (i.e., the last row) of pixel driving circuits through two number of gate lines 10.

In this way, one shift register group 20 can perform forward scanning and backward scanning on the respective gate lines 10 while reducing the number of shift registers to be arranged, and narrowing a bezel.

In some embodiments, the switch circuit 30 is between the shift register group 20 and the respective gate lines 10, so when there is only one shift register group 20 in the display panel, for forward scanning and backward scanning, the respective shift registers in the shift register group 20 are controlled by the switch circuit 30 to be connected with the respective gate lines 10. Accordingly in the embodiments of the disclosure, as illustrated in FIG. 4A and FIG. 4B, the switch circuit 30 can include first switch elements 31, and second switch elements 32, where the first switch elements 31 and the second switch elements 32 are respectively arranged with the gate lines in one-to-one manner, and are electrically connected with the gate lines 10, the first switch elements 31 are configured to transmit the scan signals for forward scanning output by the corresponding shift registers to the corresponding gate lines 10 so that the shift register group 20 performs forward scanning on the respective gate lines 10, and the second switch elements 32 are configured to transmit the scan signals for backward scanning output by the corresponding shift registers to the corresponding gate lines 10 so that the shift register group 20 performs backward scanning on the respective gate lines 10.

Stated otherwise, as illustrated in FIG. 4A and FIG. 4B, the output terminal of the i-th shift register can be electrically connected respectively with the first input terminals and the second terminals of the (i−1)-th row of pixel driving circuits, and the first input terminals and the second input terminals of the i-th row of pixel driving circuits through four number of gate lines 10 as follows.

When the output terminal of the i-th shift register is electrically connected respectively with the second terminals of the (i−1)-th row of pixel driving circuits, and the first input terminals of the i-th row of pixel driving circuits through two of the gate lines (e.g., denoted respectively as m1 and m2 only for the sake of a convenient description of the respective gate lines, although the two reference numerals m1 and m2 are not illustrated), the gate line m1 is electrically connected with the output terminal of the i-th shift register through a first switch element 31, and the gate line m2 is also electrically connected with the output terminal of the i-th shift register through a first switch element 31, in order to perform forward scanning.

When the output terminal of the i-th shift register is electrically connected respectively with the first terminals of the (i−1)-th row of pixel driving circuits, and the second input terminals of the i-th row of pixel driving circuits through two of the gate lines (e.g., denoted respectively as m3 and m4 only for the sake of a convenient description of the respective gate lines, although the two reference numerals m3 and m4 are not illustrated), the gate line m3 is electrically connected with the output terminal of the i-th shift register through a second switch element 32, and the gate line m4 is also electrically connected with the output terminal of the i-th shift register through a second switch element 32, in order to perform backward scanning.

Alike the output terminal of the first shift register can be electrically connected respectively with the first input terminals and the second input terminals of the first row of pixel driving circuits through two number of gate lines 10 as follows.

When the output terminal of the first shift register is electrically connected with the first input terminals of the first row of pixel driving circuits through one of the gate lines (e.g., denoted as m5 only for the sake of a convenient description of the respective gate lines, although the reference numeral m5 is not illustrated), the gate line m5 is electrically connected with the output terminal of the first shift register through a first switch element 31 in order to perform forward scanning.

When the output terminal of the first shift register is electrically connected with the second input terminals of the first row of pixel driving circuits through one of the gate lines (e.g., denoted as m6 only for the sake of a convenient description of the respective gate lines, although the reference numeral m6 is not illustrated), the gate line m6 is electrically connected with the output terminal of the first shift register through a second switch element 32 in order to perform backward scanning.

Alike the M-th shift register can be electrically connected respectively with the first input terminals and the second input terminals of the (M−1)-th row of pixel driving circuits through two number of gate lines 10 as follows.

When the M-th shift register is electrically connected with the second input terminals of the (M−1)-th row of pixel driving circuits through one of the gate lines (e.g., denoted as m7 only for the sake of a convenient description of the respective gate lines, although the reference numeral m7 is not illustrated), the gate line m7 is electrically connected with the output terminal of the M-th shift register through a first switch element 31 in order to perform forward scanning.

When the M-th shift register is electrically connected with the first input terminals of the (M−1)-th row of pixel driving circuits through one of the gate lines (e.g., denoted as m8 only for the sake of a convenient description of the respective gate lines, although the reference numeral m8 is not illustrated), the gate line m8 is electrically connected with the output terminal of the M-th shift register through a second switch element 32 in order to perform backward scanning.

In this way, the shift registers can be controlled by the first switch elements 31 and the second switch elements 32 to be connected with the gate lines 10 so that the shift register group 20 can perform forward scanning and backward scanning on the respective gate lines 10.

In some embodiments, in order to perform the function of the switch circuit 30, in the embodiments of the disclosure, as illustrated in FIG. 1, the display panel can further include a switch circuit control signal line K20 electrically connected with the switch circuit 30, where the switch circuit 30 can be controlled in effect through the switch circuit control signal line K20 to be turned on and turned off so that the shift register group 20 can perform forward scanning and backward scanning on the respective gate lines 10.

Accordingly in this first scheme, an operating process of the switch circuit 30 can be as follows: the switch circuit 30 transmits the scan signals output by the corresponding shift register group 20 to the respective gate lines 10 under the control of a control signal provided by the switch circuit control signal line K20.

In some embodiments of the disclosure, as illustrated in FIG. 4A and FIG. 4B, each first switch element 31 includes a third switch transistor T3, a gate of the third switch transistor T3 is electrically connected with a first sub-signal line K21, a source of the third switch transistor T3 is electrically connected with the output terminal of the shift register, and a drain of the third switch transistor T3 is electrically connected with the gate line 10, and each second switch element 32 includes a fourth switch transistor T4, a gate of the fourth switch transistor T4 is electrically connected with a second sub-signal line K22, a source of the fourth switch transistor T4 is electrically connected with the output terminal of the shift register, and a drain of the fourth switch transistor T4 is electrically connected with the gate line 10, where the switch circuit control signal line K20 includes the first sub-signal line K21 and the second sub-signal line K22.

Stated otherwise, the third switch transistor T3 can transmit the scan signal output at the output terminal of the shift register to the corresponding gate line 10 under the control of a control signal provided by the first sub-signal line K21 so that the shift register group 20 can perform forward scanning on the respective gate lines 10, and alike the fourth switch transistor T4 can transmit the scan signal output at the output terminal of the shift register to the corresponding gate line 10 under the control of a control signal provided by the second sub-signal line K22 so that the shift register group 20 can perform backward scanning on the respective gate lines 10.

It shall be noted that the output terminal of each shift register is electrically connected with gate lines 10 through the first switch element 31 and the second switch element 32, so in order to perform forward scanning and backward scanning normally in effect to thereby avoid mutual interference, when the third switch transistor T3 is turned on, the fourth switch transistor T4 shall remain turned off, and when the fourth switch transistor T4 is turned on, the third switch transistor T3 shall remain turned off. In this way, the shift registers can be controlled by the third switch transistors T3 and the fourth switch transistors T4 so that the shift register group 20 can perform scanning on the respective gate lines 10 normally in effect.

Accordingly both the third switch transistor T3 and the fourth switch transistor T4 can be P-type transistors or N-type transistors, and at this time, the control signal provided by the first sub-signal line K21 is different with the control signal provided by the second sub-signal line K22 so that only one of the third switch transistor T3 and the fourth switch transistor T4 can be turned on at a time to thereby avoid disordered scanning.

Of course, the third switch transistor T3 and the fourth switch transistor T4 can be of different types, and for example, the third switch transistor T3 is a P-type transistor, and the fourth switch transistor T4 is an N-type transistor, or the third switch transistor T3 is an N-type transistor, and the fourth switch transistor T4 is a P-type transistor.

At this time, the control signal provided by the first sub-signal line K21 is same as the control signal provided by the second sub-signal line K22, and for example, when both the control signal provided by the first sub-signal line K21, and the control signal provided by the second sub-signal line K22 are low-level signals, and the third switch transistor T3 is an N-type transistor, and the fourth switch transistor T4 is a P-type transistor, the third switch transistor T3 is turned off, and the fourth switch transistor T4 is turned on, so that the shift register group 20 can perform backward scanning on the respective gate lines.

If the third switch transistor T3 is a P-type transistor, then when the third switch transistor T3 is to be turned on, a low-level signal will be provided by the first sub-signal line K21, but in a real implementation, the level at the gate of the third switch transistor T3 may not be low enough so that the third switch transistor T3 cannot be completely turned on, so a voltage drop is generated in the scan signal after the scan signal flows through the third switch transistor T3 that the level of the scan signal transmitted to the gate line 10 is offset, thus degrading a display effect as a result. Alike if the fourth switch transistor T4 is a P-type transistor, then when the fourth switch transistor T4 is turned on, the same problem will be encountered.

Figure 5:
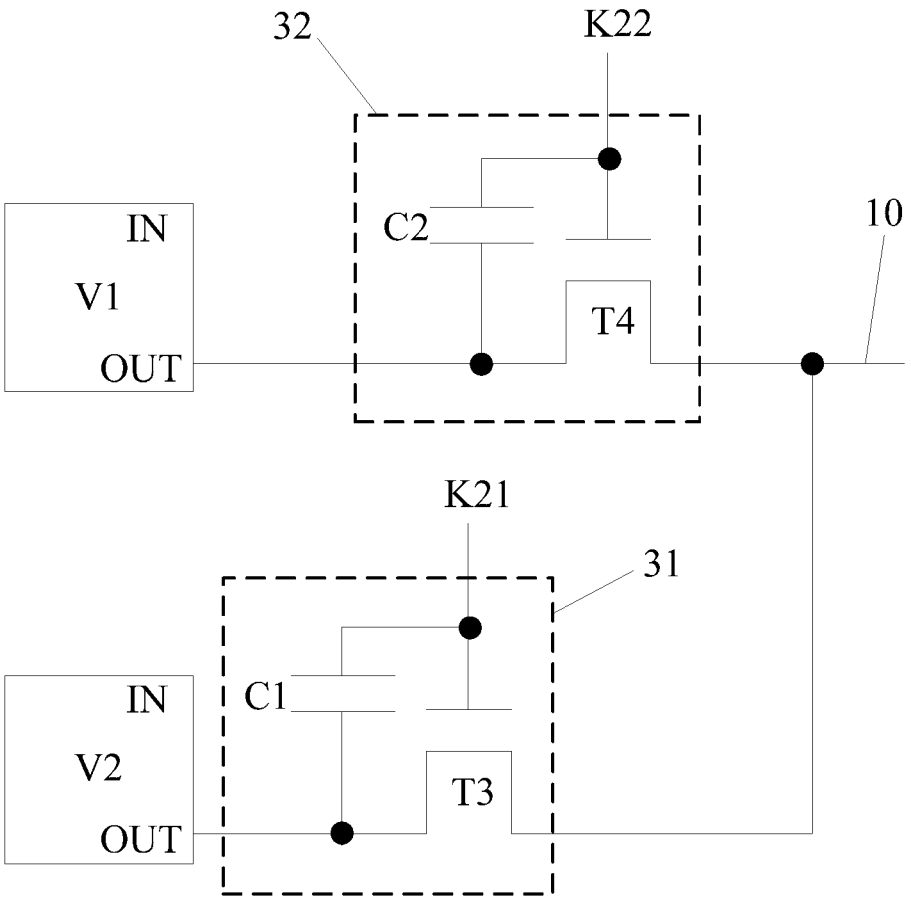
FIG. 5 is a schematic structural diagram in details of a first switch element and a second switch element according to the embodiments of the disclosure.

Hereupon in order to address the problem above, in the embodiments of the disclosure, as illustrated in FIG. 5 which is a schematic structural diagram in details of the first switch element 31 and the switch element 32, where only the first switch element 31, the second switch element 32, a part of the gate lines 10, and a part of the shift registers, which are connected, are illustrated, the first switch element 31 further includes a first capacitor C1, the first capacitor C1 is connected between the gate of the third switch transistor T3 and the source of the third switch transistor T3, and the second switch element 32 further includes a second capacitor C2, the second capacitor C2 is connected between the gate of the fourth switch transistor T4 and the source of the fourth switch transistor T4.

Stated otherwise, the first switch element 31 includes the third switch transistor T3 and the first capacitor C1, and the gate of the third switch transistor T3 can be provided with a sufficient level through the first capacitor C1 so that the third switch transistor T3 is completely turned on to transmit the scan signal in effect. For example, the third switch transistor T3 is a P-type transistor, so the level at the gate of the third switch transistor T3 can be made low enough through the first capacitor C1 so that the third switch transistor T3 can be completely turned on to transmit the scan signal to the corresponding gate line 10 so as to guarantee a normal display effect.

Alike the second switch element 32 includes the fourth switch transistor T4 and the second capacitor C2, and the gate of the fourth switch transistor T4 can be provided with a sufficient level through the second capacitor C2 so that the fourth switch transistor T4 is completely turned on to transmit the scan signal in effect. For example, the fourth switch transistor T4 is a P-type transistor, so the level at the gate of the fourth switch transistor T4 can be made low enough through the second capacitor C2 so that the fourth switch transistor T4 can be completely turned on to transmit the scan signal to the corresponding gate line 10 so as to guarantee a normal display effect.

It shall be noted that in the structure of the switch circuit 30 as illustrated in FIG. 4A and FIG. 4B, the gates of all the fourth switch transistors T4 are electrically connected with the second sub-signal line K22, and the gates of all the third switch transistors T3 are electrically connected with the first sub-signal line K21, so before the respective shift registers output the scan signal, when a valid control signal is output on the first sub-signal line K21, all the third switch transistors T3 are turned on so that the scan signals output by the respective shift registers sequentially are transmitted sequentially to the respective gate lines 10 to drive the respective rows of pixel driving circuits; or before the respective shift registers output the scan signal, when a valid control signal is output on the first sub-signal line K22, all the third switch transistors T4 are turned on so that the scan signal output by the respective shift registers sequentially is transmitted sequentially to the respective gate lines 10 to drive the respective rows of pixel driving circuits.

In some the embodiments of the disclosure, the gate circuit control signal line K10 and the switch circuit control signal line K20 can be arranged as signal lines for providing the same signal, that is, the control signal provided by the first sub-signal line K21 is same as the control signal provided by the third sub-signal line K11, or the first sub-signal line K21 and the third sub-signal line K11 can be arranged as the same signal line; and the control signal provided by the second sub-signal line K22 is same as the control signal provided by the fourth sub-signal line K12, or the second sub-signal line K22 and the fourth sub-signal line K12 can be arranged as the same signal line. In this way, the number of types or numbers of signal lines arranged in the display panel can be reduced to thereby simplify the structure of the display panel so as to lower the difficulty of fabricating the display panel.

In a second scheme, as illustrated in FIG. 2, the display panel can include a first shift register group 21 and a second shift register group 22 respectively at two ends of the gate lines 10, where the first shift register group 21 is configured to perform forward scanning on the respective gate lines 10 (as denoted by an arrow between the shift registers in FIG. 2), and the second shift register group 22 is configured to perform backward scanning on the respective gate lines 10 (as denoted by an arrow between the shift registers in FIG. 2).

Accordingly the two groups of shift registers are arranged, where the first shift register group 21 performs forward scanning on the respective gate lines 10, and the second shift register group 22 performs backward scanning on the respective gate lines 10, so that the two groups of shift registers can perform forward scanning and backward scanning respectively to thereby scan the respective gate lines 10 precisely, and avoid scanning from being disordered. Furthermore the two groups of shift registers are arranged, where the two groups of shift registers are located respectively at two ends of the gate lines 10 so that the groups of shift registers can be connected simply with the respective gate lines 10 to thereby lower the structural complexity of the display panel so as to lower the difficulty of fabricating the display panel.

In some embodiments of the disclosure, the two groups of shift registers are arranged, where the first shift register group 21 performs forward scanning on the respective gate lines 10, and the second shift register group 22 performs backward scanning on the respective gate lines 10, so each of the first shift register group 21 and the second shift register group 22 can include only shift registers, that is, each shift register group may include only shift registers, but will not include any other components in the shift register group in the first scheme (e.g., the switching elements 23).

In this way, the structure of the groups of shift registers can be greatly simplified to thereby lower the structural complexity of the display panel so as to lower the difficulty of fabricating the display panel.

Figure 6:
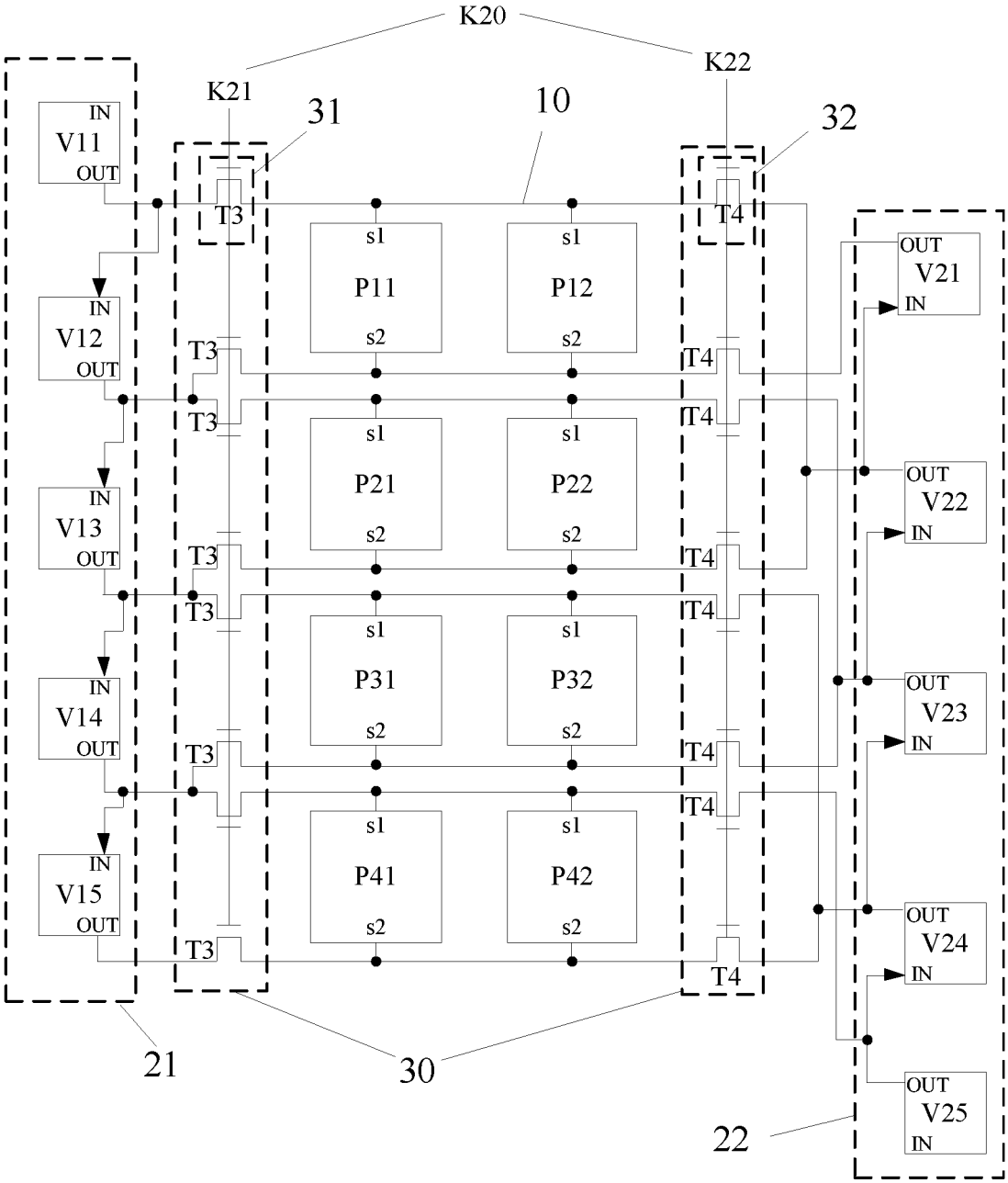
FIG. 6 is a schematic structural diagram of a switch circuit in the display panel including two groups of shift registers according to the embodiments of the disclosure.

In some embodiments, in this second scheme, the two groups of shift registers are arranged, where the first shift register group 21 performs forward scanning on the respective gate lines 10, and the second shift register group 22 performs backward scanning on the respective gate lines 10, so in the embodiments of the disclosure, the respective shift registers in the first shift register group 21 are connected with the respective gate lines 10 in a first connection relationship, and the respective shift registers in the second shift register group 22 are connected with the respective gate lines 10 in a second connection relationship different from the first connection relationship, as illustrated in FIG. 6 which is a schematic structural diagram in details of a switch circuit 30 in the display panel including two groups of shift registers.

In some embodiments, the display panel can also include pixel driving circuits 40 arranged in an array, where each pixel driving circuit 40 includes a first input terminal and a second input terminal. Accordingly in the embodiments of the disclosure, the respective shift registers in the two groups of shift registers, the respective gate lines 10, and the pixel driving circuits 40 are connected as follows.

As illustrated in FIG. 6, for M number of shift registers in the first shift register group 21, the output terminal of the i-th shift register other than the first shift register and the M-th shift register is electrically connected respectively with two adjacent gate lines 10, where one of the two adjacent gate lines 10 is electrically connected with the second input terminals of the (i−1)-th row of pixel driving circuits, and the other of the two adjacent gate lines 10 is electrically connected with the first input terminals of the i-th row of pixel driving circuits; the first shift register is electrically connected with the first input terminals of the first row of pixel driving circuits through one gate line 10; and the M-th shift register is electrically connected with the second input terminals of the (M−1)-th row of pixel driving circuits through one gate line 10.

For M number of shift registers in the second shift register group 22, the output terminal of the i-th shift register other than the first shift register and the M-th shift register is electrically connected respectively with two nonadjacent gate lines 10, where one of the two nonadjacent gate lines 10 is electrically connected with the first input terminals of the (i−1)-th row of pixel driving circuits, and the other of the two adjacent gate lines 10 is electrically connected with the second input terminals of the i-th row of pixel driving circuits; the first shift register is electrically connected with the second input terminals of the first row of pixel driving circuits through one gate line 10; and the M-th shift register is electrically connected with the first input terminals of the (M−1)-th row of pixel driving circuits through one gate line 10. Where i is an integer greater than 1 and less than M, and there are (M−1) rows of pixel driving circuits 40.

As illustrated in FIG. 6, for example, there are only four rows of pixel driving circuits denoted respectively as P11, P12, P21, P22, P31, P32, P41, and P42, the first shift register group 21 includes five shift registers denoted respectively as V11, V12, V13, V14, and V15, and the second shift register group 22 includes five shift registers denoted respectively as V21, V22, V23, V24, and V25.

In some embodiments, for the first shift register group 21, the output terminal OUT of the shift register V11 is electrically connected with the first input terminals of the first row of pixel driving circuits (e.g., s1 of P11) through one gate line 10; the output terminal OUT of the shift register V15 is electrically connected with the second input terminals of the fourth row of pixel driving circuits (e.g., s2 of P41) through one gate line 10; and the shift register V12, the shift register V13, and the shift register V14 are connected with the pixel driving circuits 40 in the same way, and for example, the shift register V12 is electrically connected with two adjacent gate lines 10, where one of the two adjacent gate lines 10 is electrically connected with the second input terminals of the first row of pixel driving circuits (e.g., s2 of P11), and the other of the two adjacent gate lines 10 is electrically connected with the first input terminals of the second row of pixel driving circuits (e.g., s1 of P21).

For the second shift register group 22, the output terminal OUT of the shift register V21 is electrically connected with the second input terminals of the first row of pixel driving circuits (e.g., s2 of P11) through one gate line 10; the output terminal OUT of the shift register V25 is electrically connected with the first input terminals of the fourth row of pixel driving circuits (e.g., s1 of P41) through one gate line 10; and the shift register V22, the shift register V23, and the shift register V24 are connected with the pixel driving circuits 40 in the same way, and for example, the shift register V22 is electrically connected with two nonadjacent gate lines 10, where one of the two nonadjacent gate lines 10 is electrically connected with the first input terminals of the first row of pixel driving circuits (e.g., s1 of P11), and the other of the two nonadjacent gate lines 10 is electrically connected with the second input terminals of the second row of pixel driving circuits (e.g., s2 of P21).

In this way, the two groups of shift registers are arranged so that the respective groups of shift registers can perform forward scanning and backward scanning on the respective gate lines 10 while the structure of the display panel is simplified, and the difficulty of fabricating the display panel is lowered.

In some embodiments, the switch circuit 30 is arranged between the corresponding shift register group and the respective gate lines 10, so when there are two groups of shift registers arranged in the display panel, if forward scanning and backward scanning is to be performed, then the respective groups of shift registers will also be controlled by the switch circuit 30 to be connected with the respective gate lines 10.

Accordingly in the embodiments of the disclosure, as illustrated in FIG. 6, the switch circuit 30 can include first switch elements 31, and second switch elements 32, where the first switch elements 31 and the second switch elements 32 are arranged respectively arranged with the gate lines in one-to-one manner, and are electrically connected with the gate lines 10, the first switch elements 31 are configured to transmit the scan signals for forward scanning output by the corresponding shift registers to the corresponding gate lines 10 so that the corresponding shift register group performs forward scanning on the respective gate lines 10, and the second switch elements 32 are configured to transmit the scan signals for forward scanning output by the corresponding shift registers to the corresponding gate lines 10 so that the corresponding shift register group performs backward scanning on the respective gate lines 10.

Furthermore as illustrated in FIG. 6, the first switch elements 31 are connected between the shift registers in the first shift register group 21, and the gate lines 10, and the second switch elements 32 are connected between the shift registers in the second shift register group 22, and the gate lines 10, and the two groups of shift registers can be controlled by the first switch elements 31 and the second switch elements 32 to be connected with the gate lines 10 so that the two groups of shift registers can perform forward scanning and backward scanning respectively on the respective gate lines 10.

As illustrated in FIG. 6, for example, for the first shift register group 21, the output terminal of the shift register V12, for example, is electrically connected respectively with two adjacent gate lines 10 through two first switch elements 31, where one of the two adjacent gate lines 10 is electrically connected with the second terminals of the first row of pixel driving circuits (e.g., the second input terminal s2 of the pixel driving circuit P11), and the other of the two adjacent gate lines 10 is electrically connected with the first input terminals of the second row of pixel driving circuits (e.g., the first input terminal s1 of the pixel driving circuit P21).

Stated otherwise, a first switch element 31 is between the output terminal of each shift register, and each gate line 10, and in this way, when the first switch elements 31 are turned on so that the first groups of shift registers 21 can perform forward scanning on the respective gate lines. Furthermore for performing forward scanning in effect, for each pixel driving circuit, the scan signal can be input to firstly the first input terminal and then the second input terminal so that the pixel driving circuit can operate normally, and thus the display panel can display an image normally.

Alike for the second shift register group 21, the output terminal of the shift register V22, for example, is electrically connected respectively with two adjacent gate lines 10 through two second switch elements 32, where one of the two adjacent gate lines 10 is electrically connected with the first terminals of the first row of pixel driving circuits (e.g., the first input terminal s1 of the pixel driving circuit P11), and the other of the two adjacent gate lines 10 is electrically connected with the second input terminals of the second row of pixel driving circuits (e.g., the second input terminal s2 of the pixel driving circuit P21).

Stated otherwise, a second switch element 32 is arranged between the output terminal of each shift register, and each gate line 10, and in this way, when the second switch elements 32 are turned on so that the second groups of shift registers 22 can perform backward scanning on the respective gate lines. Furthermore for performing backward scanning in effect, for each pixel driving circuit, the scan signal can be input to firstly the first input terminal and then the second input terminal so that the pixel driving circuit can operate normally, and thus the display panel can display an image normally.

In some embodiments, in this second scheme, there may be the following two implementations of an operating process of the switch circuit 30.

In a first implementation, when the display panel can include a switch circuit control signal line K20 electrically connected with the switch circuit 30, the switch circuit 30 transmits the scan signal output by the corresponding shift register group to the respective gate lines 10 under the control of a control signal provided by the switch circuit control signal line K20 as illustrated in FIG. 6.

Stated otherwise, the switch circuit 30 can be controlled in effect by the switch circuit control signal line K20 to be turned on and turned off so that the two groups of shift registers can perform forward scanning and backward scanning respectively on the respective gate lines 10.

In this implementation, for particular structures of the first switch elements 31 and the second switch elements 32, reference can be made to the description of the structures of the first switch elements 31 and the second switch elements 32 in the first implementation above, so a repeated description thereof will be omitted here.

It shall be noted that if two groups of shift registers are at two ends of the gate lines as illustrated in FIG. 6, but no switch circuit is arranged, then the scan signal will be received at both of the ends of each gate line while both of the two groups of shift registers are operating; and since the two groups of shift registers are configured to perform forward scanning and back scanning respectively, there are different operating processes of the two groups of shift registers, and they output different scan signals, so there may be different scan signals received at the two ends of each gate line, so that the pixel driving circuits may operate out of order, and thus the display panel may not display an image normally. Even if the shift registers for forward scanning and backward scanning are not operating concurrently, then while the shift registers for forward scanning are operating, their scan signal will be input to the shift registers for backward scanning through scan lines to start the shift registers for backward scanning, but the scan signal of the shift registers for backward scanning will be transmitted in a different direction of the shift registers for forward scanning, that the pixel driving circuits may operate out of order, and thus the display panel may not display an image normally.

Accordingly the switch circuit shall be arranged, and while the two groups of shift registers are operating, the switch circuit can control the gate lines to be electrically connected with one of the groups of shift registers so that scanning can be performed normally in order, and thus the display panel can display an image normally, but also the structural complexity of the display panel, and the difficulty of fabricating the display panel can be lowered.

Figure 7:
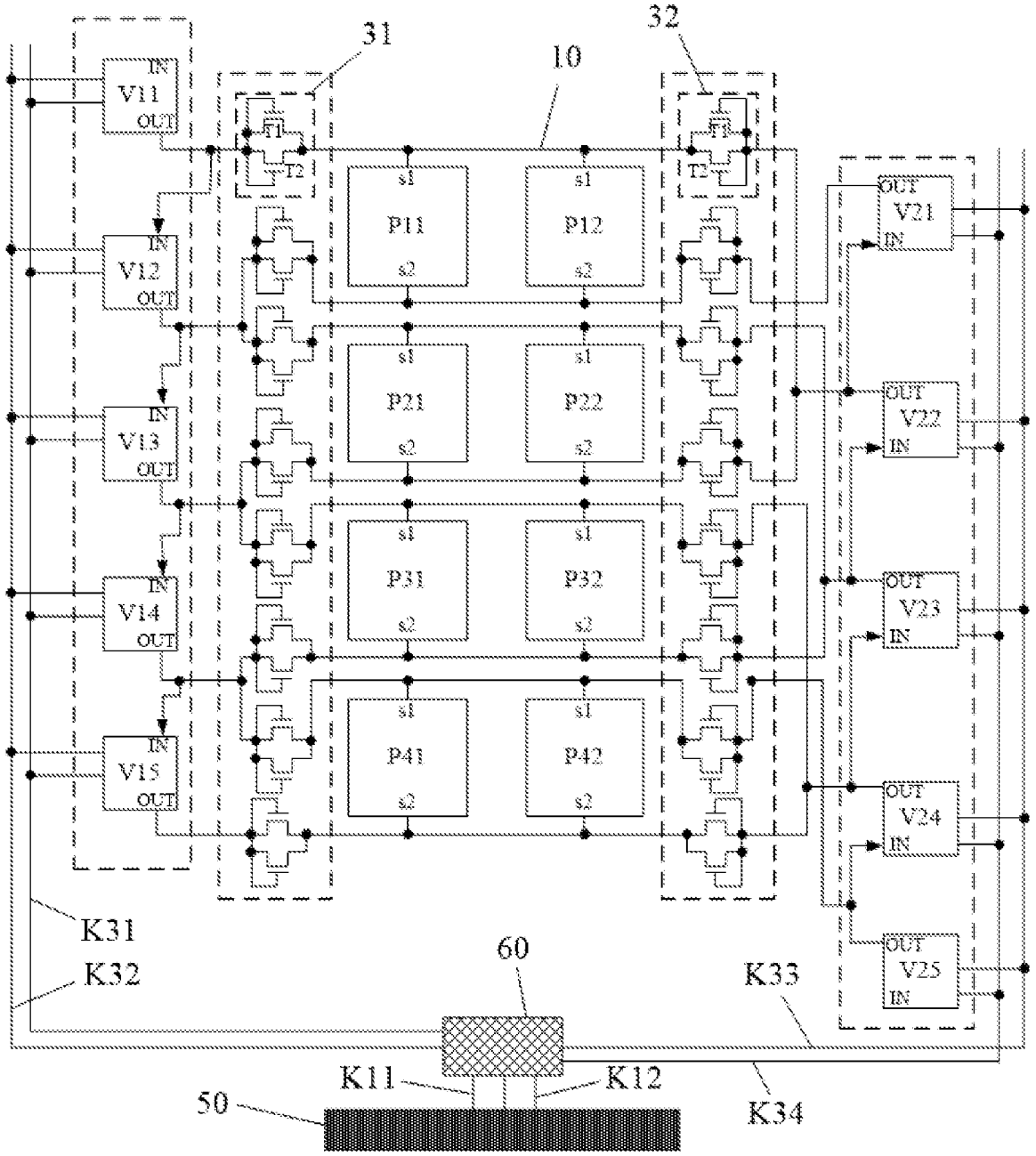
FIG. 7 is a schematic structural diagram of another switch circuit in the display panel including two groups of shift registers according to the embodiments of the disclosure.

In a second implementation, the display panel does not include a switch circuit control signal line K20 electrically connected with the switch circuit 30, so the switch circuit 30 transmits the scan signal output by the corresponding shift register group to the respective gate lines 10 under the control of the scan signal output by the corresponding shift register group as illustrated in FIG. 7 which is a schematic structural diagram of another switch circuit 30 in the display panel including two groups of shift registers.

Stated otherwise, the switch circuit 30 can be controlled by the scan signal output by the shift registers in the corresponding shift register group to be turned on and turned off so that the two groups of shift registers can perform forward scanning and backward scanning respectively on the respective gate lines 10.

In this second implementation, as illustrated in FIG. 7, the first switch elements 31 can be structurally the same as the second switch elements 32 to thereby lower the structural complexity of the switch circuit 30 so as to simplify the structure of the display panel, and to lower the difficulty of fabricating the display panel.

In some embodiments of the disclosure, as illustrated in FIG. 7, each first switch element 31 includes a first switch transistor T1 and a second switch transistor T2, where the first switch transistor T1 a gate of the first switch transistor T1 and a source of the first switch transistor T1 are electrically connected respectively with the output terminal of the shift register, and a drain of the first switch transistor T1 is electrically connected with the gate line 10, and both a gate of the second switch transistor T2 and a source the second switch transistor T2 are electrically connected with the source of the first switch transistor T1, and a drain of the second switch transistor T2 is electrically connected with the drain of the first switch transistor T1.

Alike as illustrated in FIG. 7, each second switch element 32 includes a first switch transistor T1 and a second switch transistor T2, which are connected in the same way as the first switch transistor T31 above, so a repeated description thereof will be omitted here.

In some embodiments, the first switch transistor T1 is a P-type transistor, and the second switch transistor T2 is an N-type transistor; or the first switch transistor T1 is an N-type transistor, and the second switch transistor T2 is a P-type transistor.

As illustrated in FIG. 7, for example, the first switch transistor T1 is an N-type transistor, and the second switch transistor T2 is a P-type transistor. If the shift register V11 outputs a scan signal at a high level, the first switch transistor T1 is turned on, and the second switch transistor T2 is turned off, so the first switch transistor T1 can transmit the scan signal at a high level to the corresponding gate line 10; and if the shift register V11 outputs a scan signal at a low level, the first switch transistor T1 is turned off, and the second switch transistor T2 is turned on, so the second switch transistor T2 can transmit the scan signal at a low level to the corresponding gate line 10.

It shall be noted that in the second implementation, the switch circuit 30 is controlled by the scan signal output by the shift registers in the corresponding shift register group to be turned on and turned off, and the respective cascaded shift registers in any one shift register group output the scan signal sequentially, so the respective first switch elements 31 or the respective second switch elements 32 are turned on sequentially so that the scan signals output by the respective groups of shift registers are transmitted to the corresponding gate lines 10 sequentially.

It shall be further noted that in the second implementation, the switch circuit 30 is controlled by the scan signal output by the shift registers in the corresponding shift register group to be turned on and turned off, and if both the first shift register group 21 and the second shift register group 22 are operating, that is, both of them can output their scan signals, then both the first switch elements 31 and the second switch elements 32 will be controlled by the scan signals output by the corresponding shift registers to be turned on, and at this time, two different signals may be input to the first input terminals of the pixel driving circuits 40, and two different signals may be input to the second input terminals thereof, so that the pixel driving circuits 40 cannot operate normally, thus degrading a display effect as a result.

In order to address this problem, in the embodiments of the disclosure, as illustrated in FIG. 7, the display panel further includes a driving integrated circuit 50, a gate circuit control signal line K10 electrically connected with the driving integrated circuit 50, a scan output control unit 60, and a scan signal control signal line, where the gate circuit control signal line K10 comprises a third sub-signal line K11 and a fourth sub-signal line K12, and the scan signal control signal line comprises a fifth sub-signal line K31, a sixth sub-signal line K32, a seventh sub-signal line K33, and an eighth sub-signal line K34.

In some embodiments, the respective shift registers in the first shift register group 21 are electrically connected with the fifth sub-signal line K31 and the sixth sub-signal line K32 to transmit a signal provided by the fifth sub-signal line K31, and a signal provided by the sixth sub-signal line K32 to the output terminals of the shift registers in a time division mode, and the respective shift registers in the second shift register group 22 are electrically connected with the seventh sub-signal line K33 and the eighth sub-signal line K34 to transmit a signal provided by the seventh sub-signal line K33, and a signal provided by the eighth sub-signal line K34 to the output terminals of the shift registers in a time division mode.

Furthermore the scan output control unit 60 is electrically connected respectively with the driving integrated circuit 50, the third sub-signal line K11, the fourth sub-signal line K12, the fifth sub-signal line K31, the sixth sub-signal line K32, the seventh sub-signal line K33, and the eighth sub-signal line K34, and is configured to transmit a signal output by the driving chip to the fifth sub-signal line K31 and the sixth sub-signal line K32 respectively under the control of a first control signal provided by the third sub-signal line K11, and transmit the signal output by the driving chip to the seventh sub-signal line K33 and the eighth sub-signal line K34 respectively under the control of a second control signal provided by the fourth sub-signal line K12.

In this way, the scan output control unit 60 can control one of the two groups of shift registers to output the scan signal normally, and the other shift register group not to output any scan signal so that one of the first switch elements 31 and the second switch elements 32 are turned on, and the other switch elements are turned off to thereby enable the pixel driving circuits 40 to operate normally so as to guarantee a normal display effect.

Furthermore for forward scanning, only the first shift register group 21 can output the signal normally, so the scan signal output by the shift registers in the first shift register group 21 can be transmitted to the gate lines through the switch transistors in the first switch elements 31, and further transmitted to the respective pixel driving circuits; and the second switch elements 32 are not turned on due to the connection relationship of the switch transistors in the second switch elements 32, so the scan signal will not be transmitted to the second shift register group 22. Alike for backward scanning, only the second shift register group 22 can output the scan signal normally, so the switch transistors in the first switch element 31 are turned off, and the scan signal output by the shift registers in the second shift register group 22 will not be transmitted to the first shift register group 21.

Accordingly the scan output control unit 60 can control the two groups of shift registers to operate normally respectively without interfering with each other, so as to guarantee normal scanning.

Figure 8:
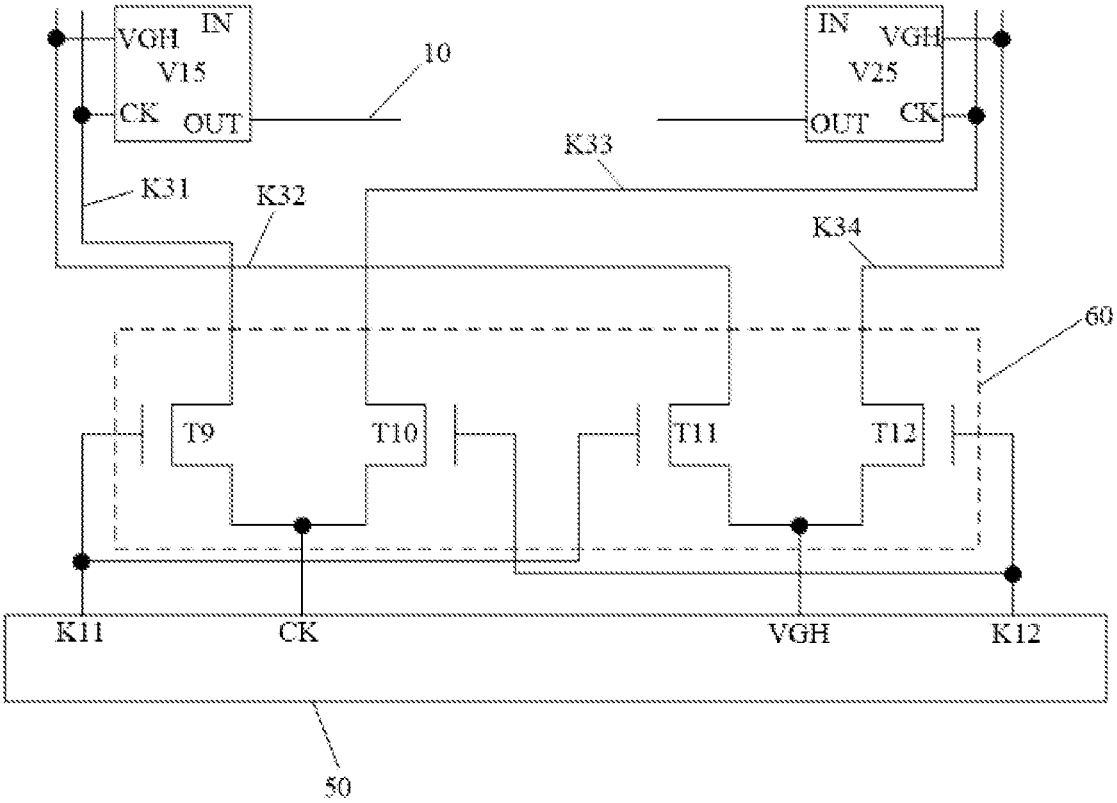
FIG. 8 is a schematic structural diagram in details of a scan output control unit according to the embodiments of the disclosure.

In the embodiments of the disclosure, as illustrated in FIG. 8 which is a schematic structural diagram in details of the scan output control unit 60, only a part of the shift registers, and a part of the gate lines 10 are illustrated, where the scan output control unit 60 includes a ninth switch transistor T9, a tenth switch transistor T10, an eleventh switch transistor T11, and a twelfth switch transistor T12; where a gate of the ninth switch transistor T9 is electrically connected with the third sub-signal line K11, a source of the ninth switch transistor T9 is electrically connected with the driving integrated circuit 50, and a drain of the ninth switch transistor T9 is electrically connected with the fifth sub-signal line K31; a gate of the tenth switch transistor T10 is electrically connected with the fourth sub-signal line k12, a source of the tenth switch transistor T10 is electrically connected with the source of the ninth switch transistor T9, and a drain of the tenth switch transistor T10 is electrically connected with the seventh sub-signal line K33; a gate of the eleventh switch transistor T11 is electrically connected with the third sub-signal line K11, a source of the eleventh switch transistor T11 is electrically connected with the driving integrated circuit 50, and a drain of the eleventh switch transistor T11 is electrically connected with the sixth sub-signal line K32; and a gate of the twelfth switch transistor T12 is electrically connected with the fourth sub-signal line K12, a source of the twelfth switch transistor T12 is electrically connected with the source of the eleventh switch transistor T11, and a drain of the twelfth switch transistor T12 is electrically connected with the eighth sub-signal line K34.

In this way, the function of the scan output control unit 60 can be performed in a simple structure so that the pixel driving circuits 40 can operate normally.

It shall be noted that as illustrated in FIG. 8, signals transmitted on the fifth sub-signal line K31 and the seventh sub-signal line K33 can be clock signals (e.g., CK), and signals transmitted on the sixth sub-signal line K32 and the eighth sub-signal line K33 can be high-voltage signals (e.g., VGH); and correspondingly two output transmission transistors can be arranged in each shift register, and for example, one of the output transistors in the shift register V15 (referred to as a first output transistor) includes a source electrically connected with the fifth sub-signal line K31 for providing a clock signal, and a drain electrically connected with the output terminal OUT, and other output transistor (referred to as a second output transistor) includes a source electrically connected with the sixth sub-signal line K32 for providing a high-voltage signal, and a drain electrically connected with the output terminal OUT. When the shift register V15 is to output a high-level signal, the second output transistor is turned on to transmit the high-voltage signal provided on the sixth sub-signal line K32 to the output terminal OUT, and when the shift register V15 is to output a low-level signal, the first output transistor is turned on to transmit the clock signal provided on the fifth sub-signal line K31 to the output terminal OUT.

Of course, if there is one output transmission transistor arranged in each shift register, then the scan signal control signal line may include only two sub-signal lines electrically connected respectively with the shift registers in the first shift register group 21, and the shift registers in the second shift register group 22; and correspondingly the scan output control unit 60 can include two switch transistors with gates controlled respectively by the third sub-signal line K11 and the fourth sub-signal line K12, sources electrically connected with the driving integrated circuit 50, and drains electrically connected respectively with the two sub-signal lines, although they are not illustrated.

Stated otherwise, both the number of sub-signal lines in the scan signal control signal line, and the number of switch transistors in the scan output control unit 60 depend upon the number of output transistors in the shift registers, and can be set as needed in reality In some embodiments, although the embodiments of the disclosure will not be limited thereto.

Of course, the structure of the scan output control unit 60 will not be limited to the structure as illustrated in FIG. 8, but can be another structure for performing the function of the scan output control unit 60, although the embodiments of the disclosure will not be limited thereto.

Figure 9:
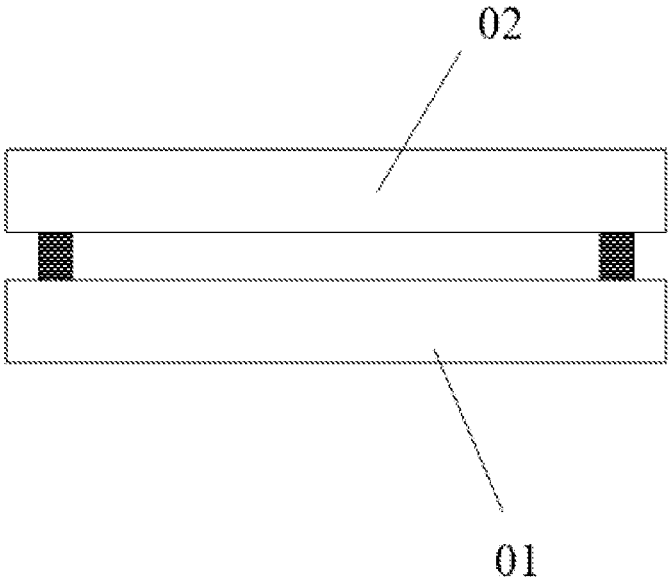
FIG. 9 is a schematic structural diagram of a display panel according to the embodiments of the disclosure.

In some embodiments, the display panel according to the embodiments of the disclosure can be an electroluminescent display panel, and In some embodiments, the electroluminescent display panel can include an array substrate 01 and an encapsulation substrate 02 arranged opposite to each other, and FIG. 9 illustrates a schematic structural diagram of the display panel.

Based upon the same inventive idea, the embodiments of the disclosure provides a method for driving the display panel above according to the embodiments of the disclosure, where the method includes:

in the condition that forward scanning on the respective gate lines, transmitting the scan signals for forward scanning corresponding to output terminals output by the corresponding shift register group to the respective gate lines through the switch circuit connected with the shift register group for performing forward scanning on the respective gate lines; and in the condition that backward scanning on the respective gate lines, transmitting the scan signals for backward scanning corresponding to output terminals output by the corresponding shift register group to the respective gate lines through the switch circuit connected with the shift register group for performing backward scanning on the respective gate lines.

In some embodiments, the method according to the embodiments of the disclosure will be described below.

Taking the structure as illustrated in FIG. 6 as an example, both the third switch transistors and the fourth switch transistors are N-type transistors.

Process of Forward Scanning

A high-level signal is output on the first sub-signal line so that the respective third switch transistors are turned on, and a low-level signal is output on the second sub-signal line so that the respective fourth switch transistors are turned off.

A valid scan signal output at the output terminal OUT of the shift register V11 is transmitted to the first input terminals s1 of the pixel driving circuits P11 and P12 through the third switch transistors, but also transmitted to the input terminal IN of the shift register V12.

A valid scan signal output at the output terminal OUT of the shift register V12 is transmitted to the second input terminals s2 of the pixel driving circuits P11 and P12 through the third switch transistors, to the first input terminals s1 of the pixel driving circuits P21 and P22 through the third switch transistors, and to the input terminal IN of the shift register V13.

Alike valid scan signals output at the output terminals OUT of the shift register V13 and the shift register V14 will flow in the same direction as the valid scan signal output at the output terminal OUT of the shift register V12, so reference can be made to the description of the shift register V12 for details thereof.

A valid scan signal output at the output terminal OUT of the shift register V15 is transmitted to the second input terminals s2 of the pixel driving circuits P41 and P42 through the third switch transistors, thus finishing forward scanning.

Process of Backward Scanning

A low-level signal is output on the first sub-signal line so that the respective third switch transistors are turned off, and a high-level signal is output on the second sub-signal line so that the respective fourth switch transistors are turned on.

A valid scan signal output at the output terminal OUT of the shift register V25 is transmitted to the first input terminals s1 of the pixel driving circuits P41 and P42 through the fourth switch transistors, but also transmitted to the input terminal IN of the shift register V24.

A valid scan signal output at the output terminal OUT of the shift register V24 is transmitted to the second input terminals s2 of the pixel driving circuits P41 and P42 through the fourth switch transistors, to the first input terminals s1 of the pixel driving circuits P31 and P32 through the fourth switch transistors, and to the input terminal IN of the shift register V23.

Alike valid scan signals output at the output terminals OUT of the shift register V23 and the shift register V24 will flow in the same direction as the valid scan signal output at the output terminal OUT of the shift register V24, so reference can be made to the description of the shift register V24 for details thereof.

A valid scan signal is output at the output terminal OUT of the shift register V21 is transmitted to the second input terminals s2 of the pixel driving circuits P11 and P12 through the fourth switch transistors, thus finishing backward scanning.

Taking the structure as illustrated in FIG. 4A and FIG. 4B as an example, all of the third switch transistor, the fourth switch transistor, the fifth switch transistor, the sixth switch transistor, the seventh switch transistor, and the eighth switch transistor are N-type transistors.

Process of Forward Scanning

A high-level signal is output on the first sub-signal line so that the respective third switch transistors are turned on, and a low-level signal is output on the second sub-signal line so that the respective switch transistors are turned off.

A high-level signal is output on the third sub-signal line so that both the seventh switch transistor and the respective fifth switch transistors are turned on, and a low-level signal is output on the fourth sub-signal line so that both the eighth switch transistor and the respective sixth switch transistors are turned off, so the input terminal IN of the shift register V1 is electrically connected with the start signal line, the input terminal IN of the shift register V5 is disconnected from the start signal line (i.e., not electrically connected with therewith), the output terminal OUT of a shift register with a lower number is electrically connected with the input terminal IN of a shift register with a higher number, and the output terminal OUT of the shift register with a higher number is disconnected from the input terminal IN of the shift register with a lower number, where the numbers of the shift registers are sorted in an ascending order of V1<V2<V3<V4<V5.

For operating processes of the shift register V1 to the shift register V5, reference can be made to the description of the shift register V11 to the shift register V15 in the forward scanning process above, so a repeated description thereof will be omitted here.

Process of Backward Scanning

A low-level signal is output on the first sub-signal line so that the respective third switch transistors are turned off, and a high-level signal is output on the second sub-signal line so that the respective switch transistors are turned on.

A low-level signal is output on the third sub-signal line so that both the seventh switch transistor and the respective fifth switch transistors are turned off, and a high-level signal is output on the fourth sub-signal line so that both the eighth switch transistor and the respective sixth switch transistors are turned on, so the input terminal IN of the shift register V1 is disconnected from the start signal line, the input terminal IN of the shift register V5 is electrically connected with the start signal line, the output terminal OUT of a shift register with a lower number is disconnected from the input terminal IN of a shift register with a higher number, and the output terminal OUT of the shift register with a higher number is electrically connected with the input terminal IN of the shift register with a lower number, where the numbers of the shift registers are sorted in an ascending order of V1<V2<V3<V4<V5.

For operating processes of the shift register V1 to the shift register V5, reference can be made to the description of the shift register V21 to the shift register V25 in the backward scanning process above, so a repeated description thereof will be omitted here.

Figure 10:
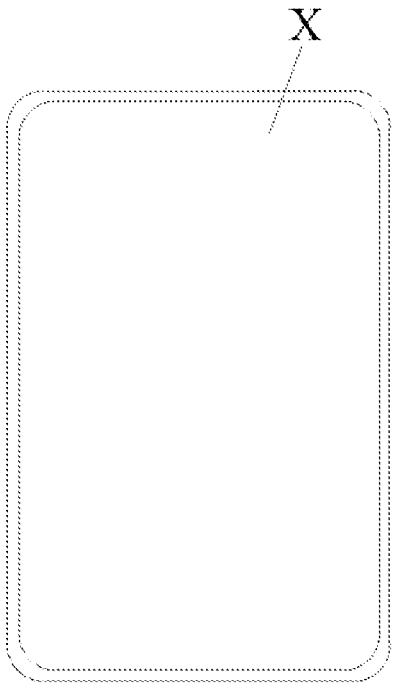
FIG. 10 is a schematic structural diagram of a display device according to the embodiments of the disclosure.

Based upon the same inventive idea, the embodiments of the disclosure provide a display device, and FIG. 10 illustrates a schematic structural diagram of the display device, where the display device can include the display panel above according to the embodiments of the disclosure.

In some embodiments, the display device can be a mobile phone (as illustrated in FIG. 10), a tablet computer, a TV set, a monitor, a notebook computer, a digital photo frame, a navigator, or any other product or component with a display function. Reference can be made to the embodiments of the display panel above for an implementation of the display device, so a repeated description thereof will be omitted here.

What is claimed is:

1. A display panel, comprising:

a plurality of gate lines;

a shift register group comprising a plurality of cascaded shift registers, wherein the plurality of shift registers are electrically connected with their corresponding gate lines, and the shift register group is configured to output scan signals for forward or backward scanning;

pixel driving circuits arranged in an array, wherein the pixel driving circuits each comprises a first input terminal and a second input terminal, the first input terminals of a row of pixel driving circuits are electrically connected with one gate line of the plurality of gate lines, and the second input terminals of the row of pixel driving circuits are electrically connected with another gate line of the plurality of gate lines; and a switch circuit, arranged between the shift register group and the respective gate lines, and configured to transmit the scan signals for forward or backward scanning output by the corresponding shift register group to the respective gate lines so that the shift register group performs forward or backward scanning on each row of the pixel driving circuits by the gate lines connected with each row of the pixel driving circuits;

wherein the shift register group performs forward scanning on the pixel driving circuits row by row from the first row to the last row by the gate lines, and the shift register group performs backward scanning on the pixel driving circuits row by row from the last row to the first row by the gate lines.

2. The display panel according to claim 1, wherein the switch circuit comprises a plurality of first switch elements, and a plurality of second switch elements, and the first switch elements and the second switch elements are respectively arranged with the gate lines in one-to-one manner, and are electrically connected with the gate lines;

the first switch elements are configured to transmit scan signals for forward scanning output by the plurality of corresponding shift registers to the corresponding gate lines, wherein the corresponding shift register group performs forward scanning on each row of the pixel driving circuits by the gate lines connected with each row of the pixel driving circuits; and the second switch elements are configured to transmit scan signals for backward scanning output by the plurality of corresponding shift registers to the corresponding gate lines, wherein the corresponding shift register group performs backward scanning on each row of the pixel driving circuits by the gate lines connected with each row of the pixel driving circuits.

3. The display panel according to claim 2, wherein the switch circuit is configured to transmit the scan signals for forward or backward scanning output by the corresponding shift register group to the respective gate lines under a control of the scan signals for forward or backward scanning output by the corresponding shift register group.

4. The display panel according to claim 3, wherein the first switch elements each comprises a first switch transistor and a second switch transistor, a gate and a source of the first switch transistor are both electrically connected with an output terminal of an shift register of the plurality of shift registers, and a drain of the first switch transistor is electrically connected with a gate line of the plurality of gate lines, and a gate and a source of the second switch transistor are both electrically connected with the source of the first switch transistor, and a drain of the second switch transistor electrically connected with the drain of the first switch transistor; and a structure of each of the first switch elements and a structure of each of the second switch elements are same.

5. The display panel according to claim 4, wherein the first switch transistor is a P-type transistor, and the second switch transistor is an N-type transistor; or the first switch transistor is an N-type transistor, and the second switch transistor is a P-type transistor.

6. The display panel according to claim 2, wherein the display panel further comprises a switch circuit control signal line electrically connected with the switch circuit; and the switch circuit is configured to transmit the scan signals for forward or backward scanning output by the corresponding shift register group to the respective gate lines under a control of a control signal provided by the switch circuit control signal line.

7. The display panel according to claim 6, wherein the first switch elements each comprises a third switch transistor, a gate of the third switch transistor is electrically connected with a first sub-signal line, a source of the third switch transistor is electrically connected with an output terminal of the shift register, and a drain of the third switch transistor is electrically connected with the gate line; and the second switch elements each comprises a fourth switch transistor, a gate of the fourth switch transistor is electrically connected with a second sub-signal line, a source of the fourth switch transistor is electrically connected with the output terminal of the shift register, and a drain of the fourth switch transistor is electrically connected with the gate line; and wherein the switch circuit control signal line comprises the first sub-signal line and the second sub-signal line.

8. The display panel according to claim 7, wherein the first switch elements each further comprises a first capacitor connected between the gate of the third switch transistor and the source of the third switch transistor; and the second switch element each further comprises a second capacitor connected between the gate of the fourth switch transistor and the source of the fourth switch transistor.

9. The display panel according to claim 6, wherein the display panel comprises one shift register group;

the display panel further comprises a gate circuit control signal line comprising a third sub-signal line and a fourth sub-signal line; and the shift register group comprises switching elements between any two adjacent levels of shift registers, wherein the switching elements each is electrically connected respectively with the third sub-signal line and the fourth sub-signal line, and is configured to transmit a scan signal output at an output terminal of a first shift register to an input terminal of a second shift register under a control of a first control signal provided by the third sub-signal line, and output a scan signal output at an output terminal of the second shift register to an input terminal of the first shift register under a control of a second control signal provided by the fourth sub-signal line, wherein the first shift register and the second shift register are two adjacent levels of shift registers.

10. The display panel according to claim 9, wherein the switching element comprises a fifth switch transistor and a sixth switch transistor;

a gate of the fifth switch transistor is electrically connected with the third sub-signal line, a source of the fifth switch transistor is electrically connected with the output terminal of the first shift register, and a drain of the fifth switch transistor is electrically connected with the input terminal of the second shift register; and a gate of the sixth switch transistor is electrically connected with the fourth sub-signal line, a source of the sixth switch transistor is electrically connected with the output terminal of the second shift register, and a drain of the sixth switch transistor is electrically connected with the input terminal of the first shift register.

11. The display panel according to claim 9, wherein:

for M number of shift registers in the shift register group, the output terminal of an i-th shift register other than a first and M-th shift registers is electrically connected respectively with the first input terminals and the second input terminals of an (i−1)-th row of pixel driving circuits, and the first input terminals and the second input terminals of an i-th row of pixel driving circuits through four number of gate lines, the output terminal of the first shift register is electrically connected respectively with the first input terminals and the second input terminals of the first row of pixel driving circuits through two number of gate lines, and an M-th shift register is electrically connected respectively with the first input terminals and the second input terminals of an (M−1)-th row of pixel driving circuits through two number of gate lines; and wherein i is an integer greater than 1 and less than M, and there are (M−1) number of rows of pixel driving circuits.

12. The display panel according to claim 2, wherein the display panel comprises a first shift register group and a second shift register group respectively at two ends of the gate lines, the first shift register group is configured to perform forward scanning on each row of the pixel driving circuits by the gate lines connected with each row of the pixel driving circuits, and the second shift register group is configured to perform backward scanning on each row of the pixel driving circuits by the gate lines connected with each row of the pixel driving circuits; and both the first shift register group and the second shift register group comprise only shift registers.

13. The display panel according to claim 12, wherein the switch circuit is configured to: transmit the scan signals for forward scanning output by the first groups of shift registers to the respective gate lines under the control of the scan signals for forward scanning output by the first groups of shift registers; or transmit the scan signals for backward scanning output by the second groups of shift registers to the respective gate lines under the control of the scan signals for forward or backward scanning output by the second groups of shift registers;

the display panel further comprises a driving integrated circuit, a gate circuit control signal line electrically connected with the driving integrated circuit, a scan output control unit, and a scan signal control signal line; the gate circuit control signal line comprises a third sub-signal line and a fourth sub-signal line, and the scan signal control signal line comprises a fifth sub-signal line, a sixth sub-signal line, a seventh sub-signal line, and an eighth sub-signal line;

the respective shift registers in the first shift register group are electrically connected with the fifth sub-signal line and the sixth sub-signal line to transmit a signal provided by the fifth sub-signal line, and a signal provided by the sixth sub-signal line to output terminals of the shift registers in a time division mode, and the respective shift registers in the second shift register group are electrically connected with the seventh sub-signal line and the eighth sub-signal line to transmit a signal provided by the seventh sub-signal line, and a signal provided by the eighth sub-signal line to the output terminals of the shift registers in a time division mode; and the scan output control unit is electrically connected respectively with a driving chip, the third sub-signal line, the fourth sub-signal line, the fifth sub-signal line, the sixth sub-signal line, the seventh sub-signal line, and the eighth sub-signal line, and is configured to transmit a signal output by the driving chip to the fifth sub-signal line and the sixth sub-signal line respectively under the control of a first control signal provided by the third sub-signal line, and transmit the signal output by the driving chip to the seventh sub-signal line and the eighth sub-signal line respectively under the control of a second control signal provided by the fourth sub-signal line.

14. The display panel according to claim 13, wherein the scan output control unit comprises a ninth switch transistor, a tenth switch transistor, an eleventh switch transistor, and a twelfth switch transistor;

a gate of the ninth switch transistor is electrically connected with the third sub-signal line, a source of the ninth switch transistor is electrically connected with the driving integrated circuit, and a drain of the ninth switch transistor is electrically connected with the fifth sub-signal line;

a gate of the tenth switch transistor is electrically connected with the fourth sub-signal line, a source of the tenth switch transistor is electrically connected with the source of the ninth switch transistor, and a drain of the tenth switch transistor is electrically connected with the seventh sub-signal line;

a gate of the eleventh switch transistor is electrically connected with the third sub-signal line, a source of the eleventh switch transistor is electrically connected with the driving integrated circuit, and a drain of the eleventh switch transistor is electrically connected with the sixth sub-signal line; and a gate of the twelfth switch transistor is electrically connected with the fourth sub-signal line, a source of the twelfth switch transistor is electrically connected with the source of the eleventh switch transistor, and a drain of the twelfth switch transistor is electrically connected with the eighth sub-signal line.

15. The display panel according to claim 12, wherein the respective shift registers in the first shift register group are connected with the respective gate lines in a first connection relationship, and the respective shift registers in the second shift register group are connected with the respective gate lines in a second connection relationship different from the first connection relationship.

16. The display panel according to claim 15, wherein:

for M number of shift registers in the first shift register group, output terminal of the i-th shift register other than the first shift register and the M-th shift register is electrically connected respectively with two adjacent gate lines, wherein one of the two adjacent gate lines is electrically connected with the second input terminals of the (i−1)-th row of pixel driving circuits, and the other of the two adjacent gate lines is electrically connected with the first input terminals of the i-th row of pixel driving circuits; the first shift register is electrically connected with the first input terminals of a first row of pixel driving circuits through one gate line; and the M-th shift register is electrically connected with the second input terminals of the (M−1)-th row of pixel driving circuits through one gate line; and for M number of shift registers in the second shift register group, output terminal of the i-th shift register other than the first shift register and the M-th shift register is electrically connected respectively with two nonadjacent gate lines, one of the two nonadjacent gate lines is electrically connected with the first input terminals of the (i−1)-th row of pixel driving circuits, and the other of the two nonadjacent gate lines is electrically connected with the second input terminals of the i-th row of pixel driving circuits; the first shift register is electrically connected with the second input terminals of the first row of pixel driving circuits through one gate line; and the M-th shift register is electrically connected with the first input terminals of the (M−1)-th row of pixel driving circuits through one gate line; and wherein i is an integer greater than 1 and less than M, and there are (M−1) number of rows of pixel driving circuits.

* * * * *